US011072511B2

(12) United States Patent
Enomoto

(10) Patent No.: US 11,072,511 B2
(45) Date of Patent: Jul. 27, 2021

(54) SHEET PRESSING DEVICE AND IMAGE FORMING SYSTEM HAVING THE SAME

(71) Applicant: Shinnosuke Enomoto, Yamanashi-ken (JP)

(72) Inventor: Shinnosuke Enomoto, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 175 days.

(21) Appl. No.: 16/536,617

(22) Filed: Aug. 9, 2019

(65) Prior Publication Data

US 2020/0207569 A1 Jul. 2, 2020

(30) Foreign Application Priority Data

Dec. 28, 2018 (JP) ..... 2018-246494
Dec. 28, 2018 (JP) ..... 2018-246497
Dec. 28, 2018 (JP) ..... JP2018-246499

(51) Int. Cl.
*B65H 37/06* (2006.01)
*B65H 45/30* (2006.01)
*B65H 45/20* (2006.01)

(52) U.S. Cl.
CPC ..... *B65H 37/06* (2013.01); *B65H 45/30* (2013.01); *B65H 45/20* (2013.01); *B65H 2301/51232* (2013.01); *B65H 2701/13212* (2013.01)

(58) Field of Classification Search
CPC ..... B65H 37/06; B65H 45/20; B65H 45/30; B65H 2301/4505; B65H 2301/51232; B65H 2701/13212; B65H 2801/27; G03G 2215/00877; B31F 1/0006; B31F 1/0035
See application file for complete search history.

(56) References Cited

U.S. PATENT DOCUMENTS 6,905,118 B2 * 6/2005 Yamada ..... B65H 45/18 270/8
7,147,598 B2 * 12/2006 Fujimoto ..... B65H 29/12 493/405
7,562,866 B2 * 7/2009 Hayashi ..... B65H 45/18 270/20.1

(Continued)

FOREIGN PATENT DOCUMENTS

JP 2004-059304 A 2/2004
JP 2012-153525 A 8/2012

*Primary Examiner* — Leslie A Nicholson, III
(74) *Attorney, Agent, or Firm* — Manabu Kanesaka

(57) ABSTRACT

A sheet pressing device includes a carry-in port that receives a Z-folded sheet having two folds; an additional folding roller disposed downstream of the carry-in port to press the fold; a lower folding guide having a pedestal disposed opposite to the additional folding roller; a first moving mechanism that moves the additional folding roller between a pressing position at which the additional folding roller is made to approach the pedestal and a retreat position at which the additional folding roller is moved relative to the pedestal from the pressing position; a second moving mechanism that moves the additional folding roller along the fold; and a control part. The control part controls the second moving mechanism so as to increase the number of times the additional folding roller is moved along the fold when a sheet section is positioned between the additional folding roller and the fold.

6 Claims, 18 Drawing Sheets

(56) References Cited

U.S. PATENT DOCUMENTS

| | | | | |
|---|---|---|---|---|
| 7,681,872 | B2 * | 3/2010 | Hayashi | B65H 29/6609 270/37 |
| 8,459,631 | B2 * | 6/2013 | Ishikawa | B42B 4/00 270/51 |
| 10,625,971 | B2 * | 4/2020 | Horiguchi | G03G 15/6541 |

* cited by examiner

SHEET PRESSING DEVICE AND IMAGE FORMING SYSTEM HAVING THE SAME

RELATED APPLICATIONS

The present application is based on, and claims priority from, Japanese Applications No. JP2018-246497 filed Dec. 28, 2018; No. 2018-246499 filed Dec. 28, 2018; and No. 2018-246494 filed Dec. 28, 2018, the disclosures of which are hereby incorporated by reference herein in their entireties.

BACKGROUND OF THE INVENTION

Field of the Invention

The present invention relates to a sheet pressing device that performs sheet folding and an image forming system, such as a copier, a printer, a facsimile, or a multifunction machine thereof, having the sheet pressing device.

Description of the Related Art

There is conventionally known a sheet folding device (post-processing device) installed in an image forming system such as a copier or a printer having a configuration in which folding processing is applied once to a sheet by means of a folding part to form a fold, followed by application of additional pressing (additional folding) to the fold by means of another pressing member for the purpose of preventing the thickness (folding height) of the fold formed in the sheet by the folding processing from being increased.

For example, Patent Document 1 discloses a sheet processing device provided with an additional folding mechanism having, on the downstream side of a pair of folding rollers that apply folding processing to a sheet, a plurality of pairs of rollers arranged parallel to the pair of rollers. In this configuration, a load is successively applied to a folded part (fold) of the sheet by the plurality of pairs of rollers to thereby perform additional folding processing without increasing processing time.

Further, Patent Document 2 discloses a sheet processing device provided with a pair of folding rollers for folding a sheet during passage of the sheet through a nip therebetween and an additional folding roller that holds the folded part of a folded sheet between itself and a lower guide plate to additionally fold the folded part. The additional folding roller is configured to be movable in a direction perpendicular to a sheet conveying direction.

PRIOR ART DOCUMENT

Patent Document

[Patent Document 1] Japanese Patent Application Publication No. 2012-153525

[Patent Document 2] Japanese Patent Application Publication No. 2004-059304

In the sheet processing device disclosed in Patent Document 1, the plurality of pairs of rollers constituting the additional folding mechanism are arranged parallel to a pair of folding rollers, so that, from a viewpoint that the direction of the fold of the sheet and the extending direction of the rotary shafts of the rollers for additional folding coincide with each other to collapse the fibers of the folded part, the effect of the additional folding is smaller than that obtained by an additional folding method in which a re-pressurization means such as a roller is moved along the fold.

Further, the sheet processing device disclosed in Patent Document 2 is configured to pressurize the fold while moving the additional folding roller in a direction perpendicular to the sheet conveying direction and can thus perform additional folding more efficiently than the additional folding method disclosed in Patent Document 1. However, the effect of the additional folding applied to the fold, that is, strengthening effect of the fold is obtained by collapsing the fibers of the fold, so that pressing force given by a rotating roller has significant influence on the strengthening effect. When additional folding is applied to a sheet, like a Z-folded sheet, in which a plurality of sheet sections partitioned by a plurality of folds are overlapped through the folds, cases where the additional folding roller directly contacts the fold and where the sheet section is interposed between the additional folding roller and the fold can occur. In the sheet folding device as disclosed in Patent Document 2, pressurization is performed under the same condition irrespective of whether the sheet section is interposed between the additional folding roller and the fold. When the sheet section is interposed between the additional folding roller and the fold, the pressing force of the additional folding roller is dispersed due to the presence of the sheet section to reduce the pressing force acting on the fold. Thus, the effect of the additional folding varies in accordance with the positional relationship among the additional folding roller, the fold and the sheet section to change the folding height.

The present invention has been made to solve the above problem associated with the conventional technique, and the object of the present invention is to prevent the folding height from being changed according to whether the additional folding roller directly contacts the fold of the sheet in additional folding processing.

SUMMARY OF THE INVENTION

In view of the above object, according to a first aspect of the present invention, there is provided a sheet pressing device that applies additional folding processing to a sheet having three sheet sections partitioned by two folds formed by folding processing and being folded in a Z-shape, the device comprising: a carry-in port that receives a sheet having two folds that have been formed in advance by folding processing and carried in a predetermined carry-in direction; an additional folding roller disposed downstream of the carry-in port in the carry-in direction and rotated about its rotation axis extending in the carry-in direction to press the fold; a pedestal disposed opposite to the additional folding roller to press the fold in cooperation with the additional folding roller; a first moving mechanism that moves the additional folding roller between a pressing position at which the additional folding roller is made to approach the pedestal to press the fold disposed between the additional folding roller and the pedestal and a retreat position at which the additional folding roller is moved relative to the pedestal from the pressing position in a direction separating from the sheet; and a second moving mechanism that moves the additional folding roller along the fold in a state where the additional folding roller is moved relative to the pedestal to the pressing position by the first moving mechanism; and a control part that controls operations of the first and second moving mechanisms. The control part controls the second moving mechanism so as to make larger the number of times the additional folding roller is moved along the fold at the pressing position when the sheet section is positioned between the additional folding roller and fold than when the additional folding roller and the fold are directly opposed to each other.

In the above sheet pressing device, the fold that has been formed in advance in the carried-in sheet is disposed between the additional folding roller and the pedestal, and the additional folding roller at the pressing position is moved relative to the pedestal along the fold, whereby additional folding can be applied to the fold. Further, direct contact between the rotating additional folding roller and the fold collapses the fibers of the fold more significantly, and the effect of the additional folding is high; however, when the sheet section is interposed between the additional folding roller and the fold, pressing force of the additional folding roller is dispersed due to the presence of the sheet section, resulting in a reduction in the pressing force applied to the fold. In the sheet pressing device according to the present invention, the the number of times the additional folding roller is moved along the fold at the pressing position is made larger when the sheet section is positioned between the additional folding roller and the fold than when the additional folding roller and the fold are directly opposed to each other, so that the period of time during which the sheet is pressed between the additional folding roller and the pedestal is elongated to increase the total amount (workload) of the pressing force applied to the sheet section and the fold between the additional folding roller and the pedestal. Thus, it is possible to prevent the total amount of the pressing force applied to the fold when the sheet section is interposed between the additional folding roller and the fold from being reduced as compared to the total amount of the pressing force applied to the fold when the sheet section is not interposed between the additional folding roller and the fold. As a result, it is possible to prevent the effect of the additional folding from varying in accordance with the positional relationship among the additional folding roller, the fold and the sheet section and thus to make the folding height more uniform irrespective of the positional relationship among the additional folding roller, the fold and the sheet section.

The above sheet pressing device may further include a sheet weight recognizing unit that acquires weight information of the sheet, and the control part may control the second moving mechanism so as to make larger the number of times the additional folding roller is moved along the fold at the pressing position when the weight of the sheet acquired by the sheet weight recognizing unit is equal to or larger than a predetermined value than when the weight of the sheet is smaller than the predetermined value. The number of times the additional folding roller is moved along the fold at the pressing position is made larger when the sheet has a weight equal to or larger than a predetermined value and is thus difficult to fold than when the sheet has a weight smaller than the predetermined value and is thus easy to fold, so that the period of time during which the sheet is pressed between the additional folding roller and the pedestal is elongated to increase the total amount (workload) of the pressing force applied to the sheet and the fold between the additional folding roller and the pedestal. As a result, the effect of strengthening the fold is increased when the sheet has a weight equal to or larger than a predetermined threshold value and is thus difficult to fold, making it possible to make the folding height more uniform irrespective of the weight of the sheet.

As one embodiment, the sheet pressing device may further include a support member and an elastic member, and the additional folding roller may be supported by the support member through the elastic member and biased toward the pedestal by the biasing member.

The control part may control the second moving mechanism so as to make lower the speed at which the additional folding roller is moved along the fold at the pressing position when the sheet section is positioned between the additional folding roller and the fold than when the additional folding roller and the fold are directly opposed to each other. The period of time during which the sheet is pressed between the additional folding roller and pedestal is increased also by reducing the speed at which the additional folding roller is moved along the fold at the pressing position, making it possible to increase the total amount (workload) of the pressing force applied to the sheet section and the fold between the additional folding roller and the pedestal. Thus, it is possible to further prevent the total amount of the pressing force applied to the fold when the sheet section is interposed between the additional folding roller and the fold from being reduced as compared to the total amount of the pressing force applied to the fold when the sheet section is not interposed between the additional folding roller and the fold. As a result, it is possible to prevent the effect of the additional folding from varying in accordance with the positional relationship among the additional folding roller, the fold and the sheet section and thus to make the folding height more uniform irrespective of the positional relationship among the additional folding roller, the fold and the sheet section.

The control part may control the first moving mechanism so as to make larger the pressing force applied to the fold between the additional folding roller and the pedestal when the sheet section is positioned between the additional folding roller and the fold than when the additional folding roller and the fold are directly opposed to each other. When the pressing force applied to the sheet between the additional folding roller and the pedestal is strengthened, the total amount (workload) of the pressing force applied to the sheet section and the fold can be increased. Thus, it is possible to further prevent the total amount of the pressing force applied to the fold when the sheet section is interposed between the additional folding roller and the fold from being reduced as compared to the total amount of the pressing force applied to the fold when the sheet section is not interposed between the additional folding roller and the fold. As a result, it is possible to prevent the effect of the additional folding from varying in accordance with the positional relationship among the additional folding roller, the fold and the sheet section and thus to make the folding height more uniform irrespective of the positional relationship among the additional folding roller, the fold and the sheet section.

Further, according to a second aspect of the present invention, there is provided an image forming system including: an image forming device that forms an image on a sheet and carries out the image-formed sheet; a sheet processing device that applies folding processing to the sheet carried out from the image forming device; and the above-described sheet pressing device.

According to the present invention, the number of times the additional folding roller is moved along the fold at the pressing position is made larger when the sheet section is positioned between the additional folding roller and the fold than when the additional folding roller and the fold are directly opposed to each other, so that the period of time during which the sheet is pressed between the additional folding roller and the pedestal is elongated to increase the total amount (workload) of the pressing force applied to the sheet section and the fold between the additional folding roller and the pedestal. Thus, it is possible to prevent the total amount of the pressing force applied to the fold when the sheet section is interposed between the additional folding roller and the from being reduced as compared to the total amount of the pressing force applied to the fold when the sheet section is not interposed between the additional folding roller and the fold. As a result, it is possible to prevent the effect of the additional folding from varying in accordance with the positional relationship among the additional folding roller, the fold and the sheet section and thus to make the folding height more uniform irrespective of the positional relationship among the additional folding roller, the fold and the sheet section.

BRIEF DESCRIPTION OF THE DRAWINGS

FIGS. 5A to 5D are explanatory views illustrating the basic operation of an additional folding part when additional folding processing is applied to a sheet in the additional folding unit, in which FIG. 5A illustrates a state where a first fold on the leading end side in the carry-in direction of the sheet is received in the additional folding part, FIG. 5B illustrates a state where additional folding rollers are moved to a pressing position to press the first fold of the sheet, FIG. 5C illustrates a state where the additional folding rollers are moved along the first fold of the sheet at the pressing position illustrated in FIG. 5B, and FIG. 5D illustrates a state where the additional folding rollers in the state illustrated in FIG. 5C are moved to a first retreat position;

FIGS. 6E to 6H are explanatory views illustrating the basic operation of an additional folding part when additional folding processing is applied to a sheet in the additional folding unit, in which FIG. 6E illustrates a state where a second fold on the rear end side in the carry-in direction of the sheet is received in the additional folding part, FIG. 6F illustrates a state where the additional folding rollers are moved to the pressing position to press the second fold of the sheet, FIG. 5G illustrates a state where the additional folding rollers are moved along the second fold of the sheet at the pressing position illustrated in FIG. 6F, and FIG. 6H illustrates a state where the additional folding rollers in the state illustrated in FIG. 6G are moved to a second retreat position;

FIGS. 8A to 8C are explanatory views illustrating the operation of the additional folding part when additional folding processing is applied to the first fold of the sheet in the additional folding unit, in which FIG. 8A illustrates a state where the first fold on the leading end side in the conveying direction of the sheet is received in the additional folding part, FIG. 8B illustrates a state where the first fold on the leading end side in the conveying direction of the sheet is pressed between the additional folding rollers and the pedestal, and FIG. 8C illustrates a state where the additional folding rollers in the state illustrated in FIG. 8B are moved to the first retreat position;

FIGS. 9D to 9F are explanatory views illustrating the operation of the additional folding part when additional folding processing is applied to the second fold of the sheet in the additional folding unit when the sheet to be processed is a thick sheet, in which FIG. 9D illustrates a state where the second fold on the rear end side in the conveying direction of the sheet is received in the additional folding part, FIG. 9E illustrates a state where the second fold on the rear end side in the conveying direction of the sheet is pressed between the additional folding rollers and the pedestal, and FIG. 9F illustrates a state where the additional folding rollers in the state illustrated in FIG. 9E are moved to the second retreat position;

FIGS. 11A to 11D are explanatory views illustrating the operation of the additional folding part when additional folding processing is applied to the sheet in the second embodiment, in which FIGS. 11A to 11D are side views of the additional folding part corresponding to FIGS. 5A to 5D, respectively;

FIGS. 12E to 12H are explanatory views illustrating the operation of the additional folding part when additional folding processing is applied to the sheet in the second embodiment, in which FIGS. 12E to 12H are side views of the additional folding part corresponding to FIGS. 6E to 6H, respectively;

FIGS. 15A to 15C are explanatory views illustrating the operation of the additional folding part when additional folding processing is applied to the sheet in the third embodiment, in which FIG. 15A illustrates a state where the first fold on the leading end side in the carry-in direction of the sheet is received in the additional folding part, FIG. 15B illustrates a state where the first fold on the leading end side in the sheet conveying direction of the sheet is pressed between the additional folding rollers and the pedestal; and, FIG. 15C illustrates a state where the additional folding rollers in the state illustrated in FIG. 15B are moved to the first retreat position;

FIGS. 16D to 16F are explanatory views illustrating the operation of the additional folding part when additional folding processing is applied to the sheet in the third embodiment, in which FIG. 16D illustrates a state where the second fold on the rear end side in the carry-in direction of the sheet is received in the additional folding part, FIG. 16E illustrates a state where the second fold on the rear end side in the sheet conveying direction of the sheet is pressed between the additional folding rollers and the pedestal; and, FIG. 16F illustrates a state where the additional folding rollers in the state illustrated in FIG. 16E are moved to the second retreat position;

DESCRIPTION OF THE PREFERRED EMBODIMENTS

Figure 1:
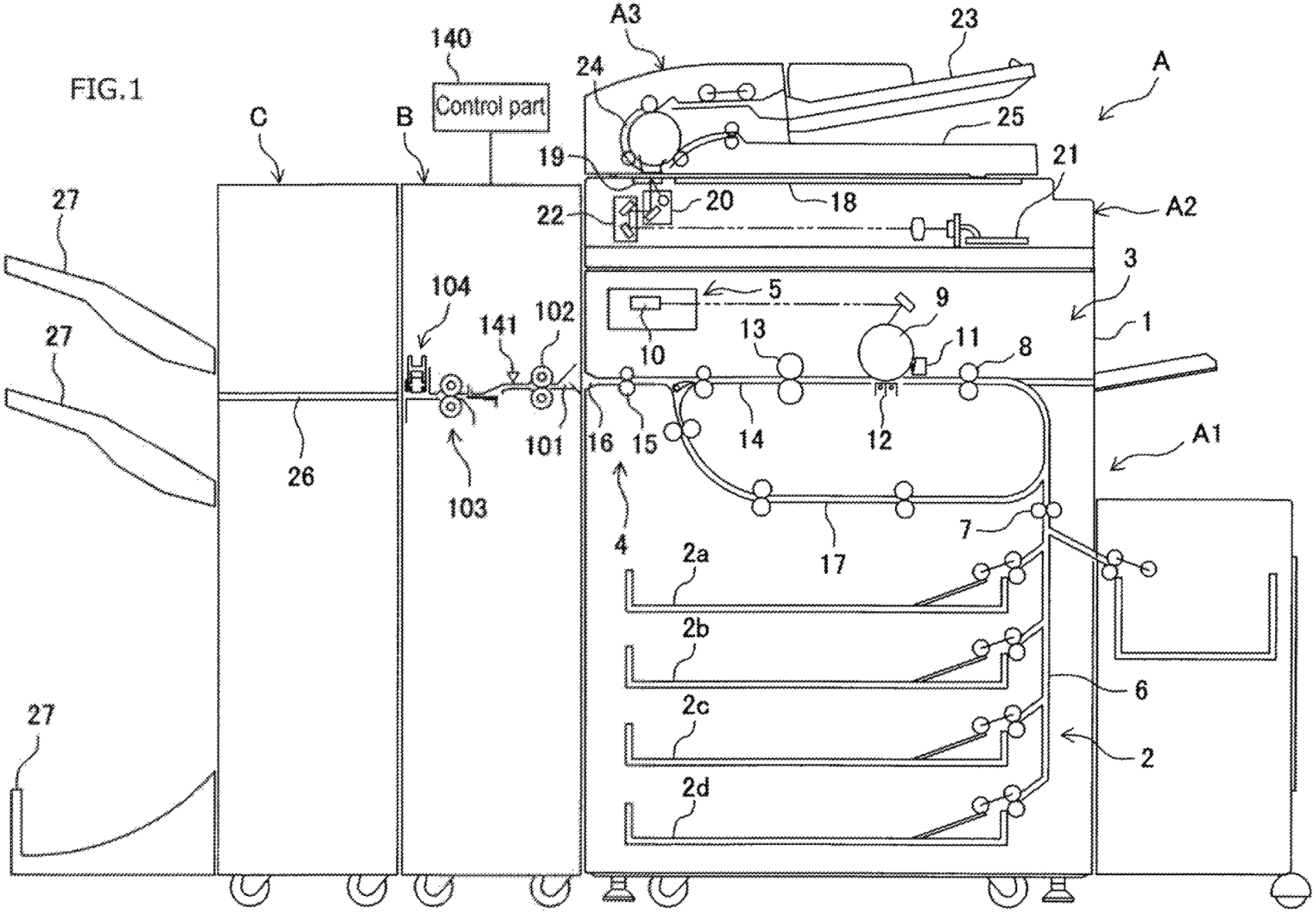
FIG. 1 is an entire configuration view of an image forming system provided with a sheet pressing device according to the present invention.

Hereinafter, preferred embodiments of the present embodiments will be described with reference to the accompanying drawings. Throughout the drawings, the same reference numerals are used to designate the same or similar components.

First, with reference to FIG. 1, the entire configuration of an image forming system provided with a folding device having an additional folding unit as a sheet pressing device according to the present invention will be described. The image forming system includes an image forming device A, a folding device B and a post-processing device C. A sheet S on which an image is formed by the image forming device A is subjected to folding processing by the folding device B and is thereafter subjected to stapling and aligning processing as needed by the post-processing device C on the downstream side. The resultant sheet S is discharged to a storage tray 27 on the downstream side. The image forming system can include devices of various structures, such as a copier, a printer and a press. Hereinafter, the image forming device A, folding device B and post-processing device C will be individually described in detail.

Image Forming Device

As illustrated in FIG. 1, the image forming device A includes an image forming unit A1, an image reading unit A2 and a document feeding unit A3. The image forming unit A1 has, in a device housing 1, a sheet feeding part 2, an image forming part 3, a sheet discharge part 4 and a data processing part 5.

The sheet feeding part 2 includes a plurality of cassettes 2*a*, 2*b*, 2*c* and 2*d*. The cassettes 2*a*, 2*b*, 2*c* and 2*d* can individually store therein sheets S of different standard sizes selected ahead of time, respectively. Each of the cassettes 2*a*, 2*b*, 2*c*, and 2*d* incorporates a separating mechanism for separating the sheets S therein one from another and a sheet feeding mechanism for delivering the sheet S. The thus configured sheet feeding part 2 delivers the sheet S of a size specified by a main body control part (not illustrated) to a sheet feeding path 6. In the sheet feeding path 6, a conveying roller 7 and a resist roller 8 are provided. The conveying roller 7 is disposed at the intermediate portion of the sheet feeding path 6 and configured to convey downstream the sheet S supplied from the plurality of cassettes 2*a*, 2*b*, 2*c* and 2*d*. The resist roller 8 is disposed at the end portion of the sheet feeding path 6 and is configured to align the sheets S at their leading ends. The sheets S aligned at their leading ends by the resist roller 8 is fed to the image forming part 3 on the downstream side at a predetermined timing.

The image forming part 3 may be configured at least to form an image on the sheet S fed from the sheet feeding part 2, and various image forming mechanisms can be adopted as the image forming part 3. In the illustrated embodiment, an electrostatic type image forming mechanism is exemplified as the image forming part 3. However, the image forming part 3 is not limited to such an electrostatic type image forming mechanism as illustrated, but an inkjet type image forming mechanism, an offset type image forming mechanism and the like can be adopted as the image forming part 3.

The image forming part 3 illustrated in FIG. 1 is provided with a photoreceptor 9 (drum, belt) and a light emitter 10 that emits optical beam to the photoreceptor 9, and a developer 11 and a cleaner (not illustrated) are disposed around the rotating photoreceptor 9. The illustrated example is a monochrome print mechanism, wherein a latent image is optically formed on the photoreceptor 9 by the light emitter 10, and toner ink is applied to the latent image by the developer 11. The ink image (ink toner) applied onto the photoreceptor 9 is image-transferred, by a transfer charger 12, onto the sheet S fed from the sheet feeding part 2, and the image-transferred sheet S is subjected to image-fixing by a fixing roller 13. The resultant sheet S is fed to a sheet discharge path 14. Further, a circulation path 17 is provided in the image forming part 3, wherein the sheet S from the sheet discharge path 14 is turned upside down in a switch-back path and is fed once again to the resist roller 8, then subjected to image formation on the back surface, and fed to the sheet discharge path 14. The sheet discharge path 14 has a sheet discharge roller 15, and a sheet discharge port 16 is formed at the end thereof. The image-formed sheet S is conveyed by the sheet discharge roller 15 to the folding device B through the sheet discharge port 16.

The image reading unit A2 is provided above the thus configured image forming unit A1. The image reading unit A2 is configured to optically read a document image formed in the image forming part 3. Further, the document feeding unit A3 is mounted on the image reading unit A2.

The image reading unit A2 includes first and second platens 18 and 19 each made of a transparent glass, a reading carriage 20, a light source mounted on the reading carriage 20, a photoelectric conversion element 21 and a reduction optical system 22 constituted by combining a mirror and a lens. In the image reading unit A2, the image on the document sheet S placed on the first platen 18 is irradiated with light from the light source while the reading carriage 20 is moved along the first platen 18, and reflected light from the image on the document sheet S is guided by the reduction optical system 22 to the photoelectric conversion element 21, whereby the image on the document sheet S is read. The photoelectric conversion element 21 converts read image data into an electric signal and transfers the obtained electric signal to the image forming part 3.

The document feeding unit A3 includes a sheet feeding tray 23, a sheet feeding path 24 and a sheet discharge tray 25. In the document feeding unit A3, documents placed on the sheet feeding tray 23 are fed one by one along the sheet feeding path 24, made to pass on the second platen 19, and discharged to the sheet discharge tray 25. When the document fed from the sheet feeding tray 23 and passing on the second platen 19 is read, the reading carriage 20 is stopped ahead of time below the second platen 19, and image data is generated from the image passing on the second platen 19.

Post-Processing Device

The post-processing device C is connected to the downstream side of the folding device B connected to the image forming device A and is configured to receive the sheet S (that has been subjected to folding processing or has not been subjected thereto) from the folding device B and apply stapling processing and aligning processing as needed.

A post-processing path 26 is provided inside the post-processing device C, and post-processing units (not illustrated) such as a stapling unit and an aligning unit are disposed along the post-processing path 26. The post-processing device C receives the sheet S discharged from the image forming device A through the folding device B, applies, as needed, stapling processing and aligning processing to the received sheet S by the post-processing units such as the stapling unit and the aligning unit, and discharges the resultant sheet S to the storage tray 27 for storage.

Folding Device

The folding device B connected to the image forming device A is configured to receive the image-formed sheet S discharged from the sheet discharge port 16 of the image forming device A and apply folding processing to the sheet S.

Figure 2:
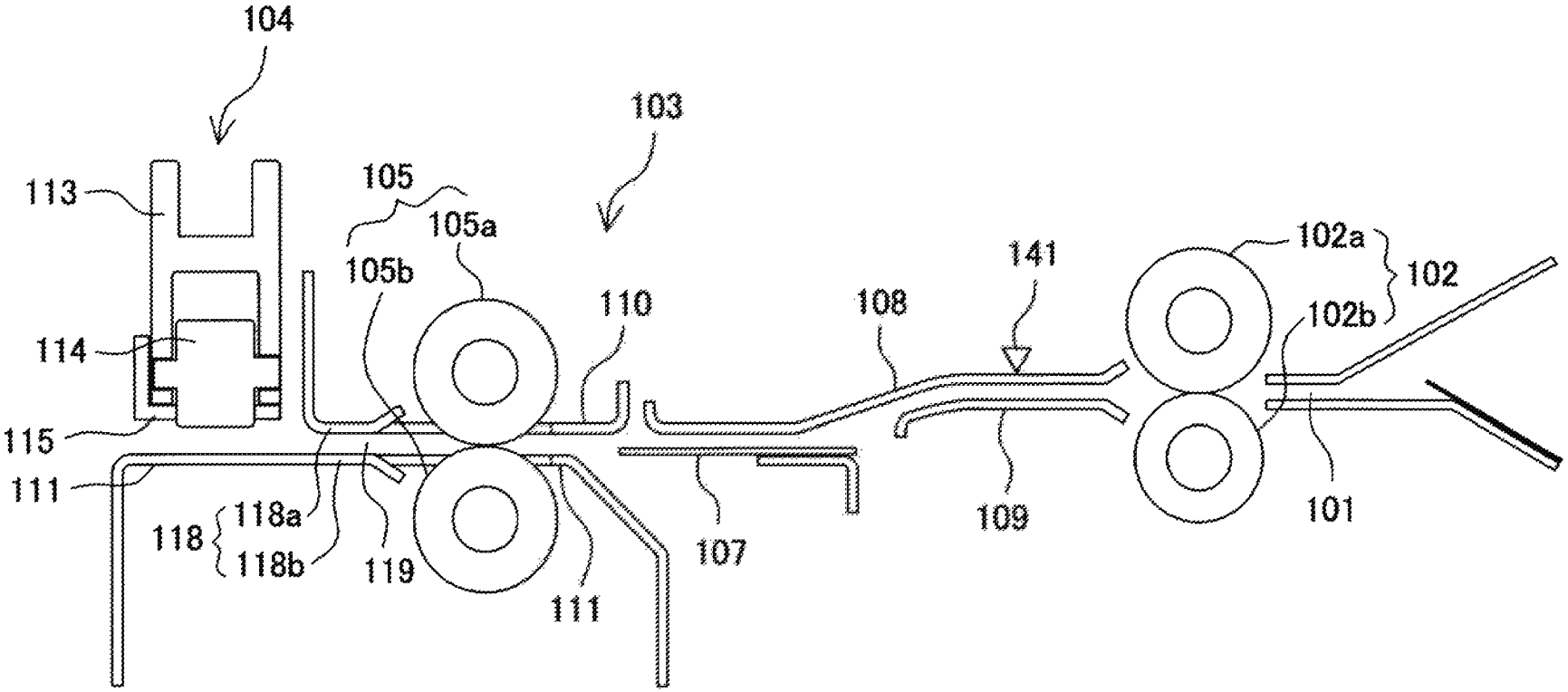
FIG. 2 is an explanatory view illustrating the main part of a folding mechanism and an additional folding unit (corresponding to the sheet pressing device) of the folding device illustrated in FIG. 1.

FIG. 2 illustrates the internal configuration of the folding device B. The folding device B has a control part 140 that controls the operation thereof. Inside the folding device B, a conveying path 101 extending substantially horizontally is provided. In the conveying path 101, one or a plurality of conveying roller pairs 102, a sheet weight detection sensor 141 which is a sheet weight recognizing means, and a folding mechanism 103 disposed downstream of the conveying roller pair 102 are provided. Further, an additional folding unit 104 corresponding to the sheet pressing device according to the present invention is provided at the end of the conveying path 101 on the downstream side of the folding mechanism 103. The folding device B is configured to apply folding processing to the sheet S conveyed along the conveying path 101 using the folding mechanism 103, apply additional folding processing to the resultant sheet S using the additional folding unit 104, and pass the resultant sheet S to the post-processing device C.

As illustrated in FIG. 1, the conveying path 101 is disposed so as to be connected to the sheet discharge port 16 of the image forming device A, whereby the sheet S discharged from the sheet discharge port 16 can be carried in the folding device B through the conveying path 101. A discharge port of the additional folding unit 104 is also connected to the post-processing path 26 of the post-processing device C, whereby the sheet S discharged from the additional folding unit 104 can be carried in the post-processing device C through the post-processing path 26.

The conveying roller pair 102 is formed of a rubber roller and includes an upper conveying roller 102*a* disposed on the upper side and a lower conveying roller 102*b* disposed on the lower side so as to be opposed to the upper conveying roller 102*a*. In the present embodiment, the upper conveying roller 102*a* is connected to a not-shown conveying roller drive motor, so as to be rotated with the rotation of the conveying roller drive motor. On the other hand, the lower conveying roller 102*b* is brought into press-contact with the upper conveying roller 102*a* by biasing force of a not-shown spring, so as to follow the rotation of the upper conveying roller 102*a*. However, the conveying roller pair 102 is not limited to the above-described configuration and may have any appropriate configuration as long as it can convey the sheet S.

The sheet weight detection sensor 141 which is a sheet weight recognizing means acquires information concerning the weight of the sheet S conveyed in the conveying path 101 by, e.g., ultrasonic waves. The acquired information concerning the weight of the sheet S is transmitted to the control part 140 and is used in additional folding processing performed by the additional folding unit 104 as described later. The sheet weight detection by means of the sheet weight detection sensor 141 is a known technique, so that detailed description of a measurement principle of the sensor 141 and the structure thereof will be omitted here. Although the sheet weight detection sensor 141 is used as the sheet weight recognizing means in the present embodiment, the sheet weight recognizing means may be realized by any other configuration as long as it can acquire information concerning the weight of the sheet S. For example, as the sheet weight recognizing means, a data storage part storing information concerning the weights of various sheet types may be used. In this case, an operator using the image forming system selects information concerning the weight of the sheet S based on the type of the sheet S, and the selected information is supplied from the data storage part to the control part 140.

The folding mechanism 103 is constituted of a folding roller pair 105 and a push plate 107. The folding roller pair 105 is formed of a rubber roller and includes an upper folding roller 105*a* disposed on the upper side and a lower folding roller 105*b* disposed on the lower side so as to be opposed to the upper folding roller 105*a*. The lower folding roller 105*b* is brought into press-contact with the upper folding roller 105*a* by biasing force of a not-shown spring. The upper folding roller 105*a* and the lower folding roller 105*b* are connected in common to a not-shown folding roller drive motor and are rotated in the mutually opposite directions with the rotation of the folding roller drive motor. The push plate 107 is disposed between the conveying roller pair 102 and the folding roller pair 105 and is connected to a not-shown push plate drive motor. The push plate 107 is configured to be moved in parallel to the conveying path on the upstream side of the folding roller pair 105 with the driving of the push plate drive motor.

In the conveying path 101 between the conveying roller pair 102 and the folding roller pair 105, an upper conveying guide 108, a lower conveying guide 109, an upper folding guide 110 and a lower folding guide 111 are provided.

The upper conveying guide 108 is formed so as to extend from a location immediately downstream of the conveying roller pair 102 to a location above the push plate 107 so as to guide the leading end of the sheet S from the conveying roller pair 102 to the push plate 107. The upper conveying guide 108 regulates the direction of the flow of the sheet S conveyed in the conveying path 101. The upper conveying guide 108 is disposed above the conveying path 101 and has a shape bent downward toward the downstream side. The upper folding guide 110 is disposed between the upper conveying guide 108 and the folding roller pair 105 and extends to a location immediately upstream of the folding roller pair 105 so as to guide the leading end of the sheet S and a folded part (to be described later) of the sheet S to the folding roller pair 105. The upper folding guide 110 regulates the direction of the flow of the sheet S in the folding mechanism 103 and is disposed above the conveying path 101 on the downstream side of the upper conveying guide 108.

The lower conveying guide 109 regulates the direction of the flow of the sheet S conveyed in the conveying path 101. The lower conveying guide 109 is disposed below the conveying path 101 and has a shape bent downward toward the downstream side like the upper conveying guide 108. The lower conveying guide 109 is terminated in front of the push plate 107, so that a vacant space is formed on the downstream side of the lower conveying guide 109. The lower folding guide 111 is disposed downstream of the push plate 107 and extends over the upstream and downstream sides of the folding roller pair 105. A part of the lower folding guide 111 on the upstream side relative to the folding roller pair 105 has a horizontal surface for guiding the leading end of the conveyed sheet S and a folded part (to be described later) of the sheet S to a nip of the folding roller pair 105 and an inclined surface for easily guiding the leading end and the folded part of the sheet S to the horizontal surface.

The push plate 107 is configured to be horizontally moved by a not-shown push plate drive device and the control part 140. Further, the push plate 107 is disposed so as to fill the space between the lower conveying guide 109 and the lower folding guide 111 and thus to guide the leading end of the sheet S being conveyed to the lower folding guide 111 when the sheet S is to be conveyed to the folding roller pair 105 along the conveying path 101 by the conveying roller pair 102. How the push plate 107 operates in folding processing will be described later.

Figure 3:
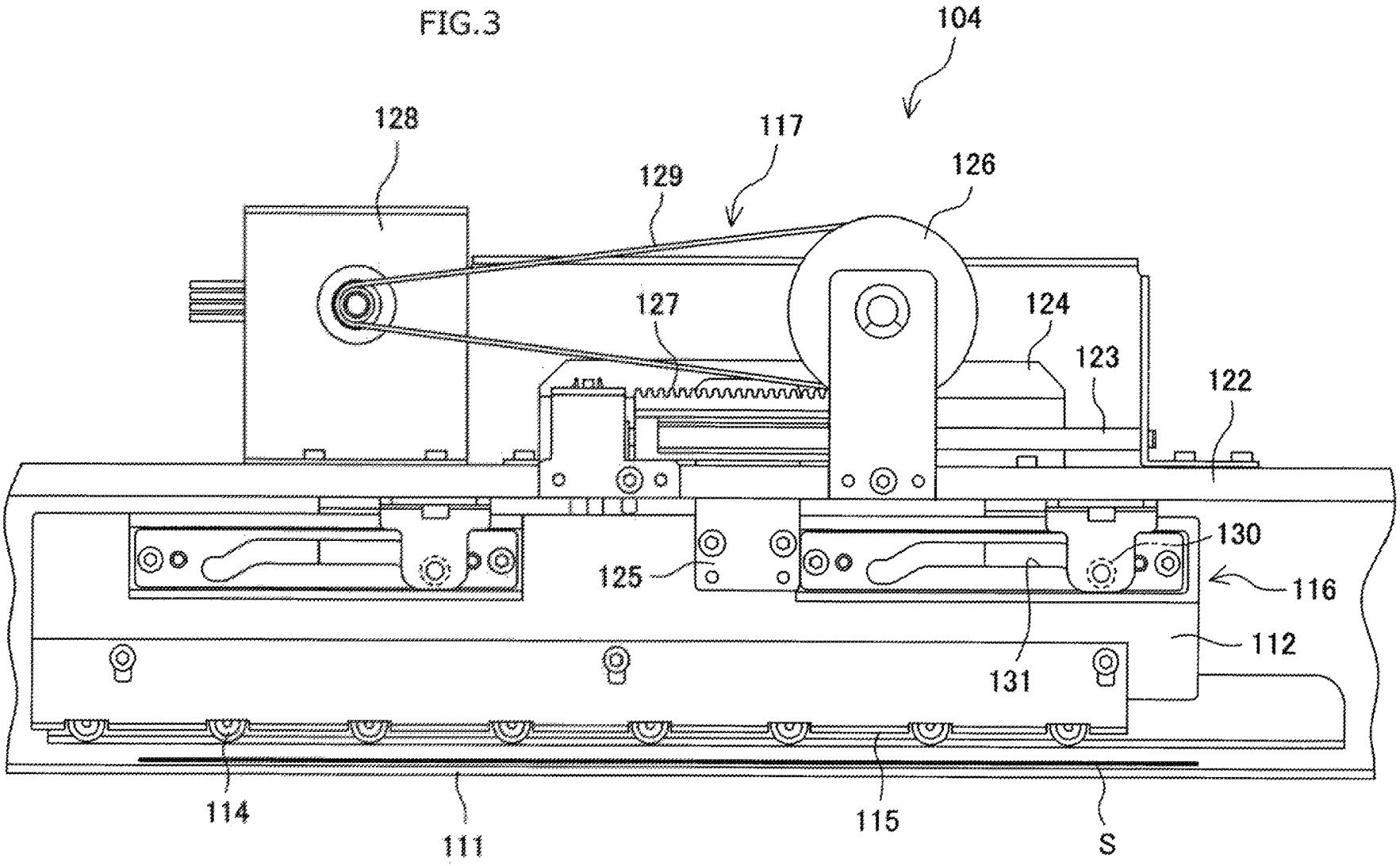
FIG. 3 is a view illustrating an additional folding unit of the folding device illustrated in FIG. 1 as viewed from the side of a discharge port thereof.

The following describes the configuration of the additional folding unit 104 with reference to FIG. 3. The additional folding unit 104 is disposed above the lower folding guide 111 on the downstream side of the folding roller pair 105 in the conveying direction of the sheet S. The additional folding unit 104 includes a movable support member 112, a plurality of additional folding rollers 114 supported by the support member 112, a regulating member 115 attached to the support member 112, a first moving mechanism 116 that moves the support member 112 in a direction approaching or separating from the lower folding guide 111, and a second moving mechanism 117 that horizontally moves the support member 112 along the fold of the sheet S. Parts of the respective upper folding guide 110 and lower folding guide 111 vertically opposed to each other on the downstream side relative to the folding roller pair 105 function as a pair of carry-in guides 118 that guide the sheet S to the additional folding unit 104, and the upstream side end portions of the pair of carry-in guides 118 serve as a carry-in port 119 of the additional folding unit 104. Further, the additional folding rollers 114 supported by the above-described support member 112 and lower folding guide 111 constitute an additional folding part, and a part of the lower folding guide 111 vertically opposed to the additional folding rollers 114 functions as a pedestal (hereinafter, referred to as a pedestal part).

The additional folding rollers 114 are arranged in a pressing member arrangement area so as to be separated from one another at equal intervals along the fold of the sheet S so as to be each rotatable about the rotation axis thereof extending in the conveying direction (in a direction parallel to the upper surface of the pedestal part of the lower folding guide 111 and perpendicular to the fold of the sheet S) of the sheet S and are supported by the support member 112. The first moving mechanism 116 moves the support member 112 supporting the additional folding rollers 114 in a direction approaching or separating from the pedestal part of the lower folding guide 111. This allows the additional folding rollers 114 to approach or separate from the pedestal part of the lower folding guide 111, thereby making it possible to move the additional folding rollers 114 to a pressing position pressing the fold of the sheet S disposed between the additional folding rollers 114 and the pedestal part of the lower folding guide 111 by the additional folding rollers 114 and the pedestal part of the lower folding guide 111 and to a retreat position separating the additional folding rollers 114 from the pressing position in a direction away from the sheet S. Further, the second moving mechanism 117 moves the support member 112 in the horizontal direction (left-right direction in FIG. 3) at the pressing position to move the additional folding rollers 114 along the fold of the sheet S. The additional folding rollers 114 and the pedestal part of the lower folding guide 111 are brought into direct contact with each other when the sheet S is not interposed therebetween at the pressing position. The length (i.e., the distance between the additional folding rollers 114 positioned at both the outermost ends of the pressing member arrangement area) of the pressing member arrangement area is set such that, when the support member 112 is moved from the retreat position to the pressing position, one end portion (end portion on the upstream side in the moving direction of the additional folding rollers 114) of the fold of the sheet S is disposed between the two adjacent additional folding rollers 114 positioned at one outermost end and that the additional folding roller 114 positioned at the other outermost end is disposed on the fold. Preferably, as in the illustrated embodiment, the length of the pressing member arrangement area, i.e., the length between the additional folding rollers 114 positioned at both the outermost ends of the pressing member arrangement area is smaller than the length of the fold of the sheet S carried in the additional folding unit 104 by one pitch (interval between the two adjacent additional folding rollers 114) of the arrangement of the additional folding rollers 114. In this case, the number of required additional folding rollers 114 can be reduced to in turn cut back on the cost of the additional folding rollers 114. Further, since the number of the additional folding rollers 114 supported by the support member 112 can be reduced, pressing force applied by each individual additional folding roller 114 against the sheet S is increased to enhance the effect of the additional folding, enabling the operation of additional folding with less strength.

The additional folding unit 104 receives the sheet S therein in a state where the additional folding rollers 114 are disposed at the retreat position from the pedestal part of the lower folding guide 111 or a reception position separated from the pedestal part away more than the pressing position is. Thereafter, a sheet position detection means (not illustrated) provided upstream of the folding roller pair 105 is used to detect the position of the sheet S and, when the fold of the sheet S has reached below the additional folding rollers 114, the sheet S is stopped, and the first moving mechanism 116 is used to move the additional folding rollers 114, relative to the pedestal part of the lower folding guide 111, to the pressing position. The sheet S is carried in the additional folding unit 104 such that, when the additional folding rollers 114 are moved to the pressing position, one end portion (end portion on the upstream side in the moving direction along the fold) of the fold is disposed between the two adjacent additional folding rollers 114 positioned at one outermost end of the pressing member arrangement area and that the other end portion (end portion on the downstream side in the moving direction along the fold) of the fold is disposed outside (i.e., outside of the additional folding roller 114 positioned at the other outermost position of the pressing member arrangement area) of the pressing member arrangement area. Further, the second moving mechanism 117 is used to move the additional folding rollers 114 positioned at the pressing position relative to the pedestal part of the lower folding guide 111 along the fold of the sheet S to press (additionally folds) the entire fold of the sheet S with the additional folding rollers 114, thereby strengthening the fold. As described above, the additional folding rollers 114 and the lower folding guide 111 (specifically, the pedestal part thereof) function as a pressing member.

Further, the regulating member 115 having a substantially L-shaped cross section and attached to the support member 112 is disposed outside the additional folding rollers 114 positioned at both the outermost ends and between the adjacent additional folding rollers 114 disposed spaced apart from each other. During the additional folding operation in which the additional folding rollers 114 are moved along the fold of the sheet S at the pressing position relative to the pedestal part of the lower folding guide 111, the regulating member 115 is disposed at a regulating position at which a distance d1 between the bottom surface (i.e., the surface facing the pedestal part of the lower folding guide 111) of the regulating member 115 and the upper surface of the pedestal part of the lower folding guide 111 is smaller than a normal vertical dimension of the conveying path, for example, a distance d2 between the pair of carry-in guides 118 (upper carry-in guide 118*a* and lower carry-in guide 118*b*) constituting the carry-in path continued from the carry-in port 119 of the additional folding unit 104 and is moved along the fold of the sheet S together with the support member 112 while keeping the distance d1. The distance d1 between the bottom surface of the regulating member 115 and the upper surface of the pedestal part of the lower folding guide 111 is set so as to prevent the above members from contacting each other. With this configuration, the regulating member 115 presses down the fold prior to the pressing by the additional folding rollers 114 to make the height of the fold less than the distance between the upper carry-in guide 118*a* and the lower carry-in guide 118*b*. In this state, additional folding (pressing against the fold of the sheet S) by the additional folding rollers 114 can be performed.

A gap between the additional folding rollers 114 and the pedestal part of the lower folding guide 111 and a gap between the regulating member 115 and the pedestal part of the lower folding guide 111 are each maintained constant over the entire area thereof in the direction along the fold of the sheet S.

Figure 4:
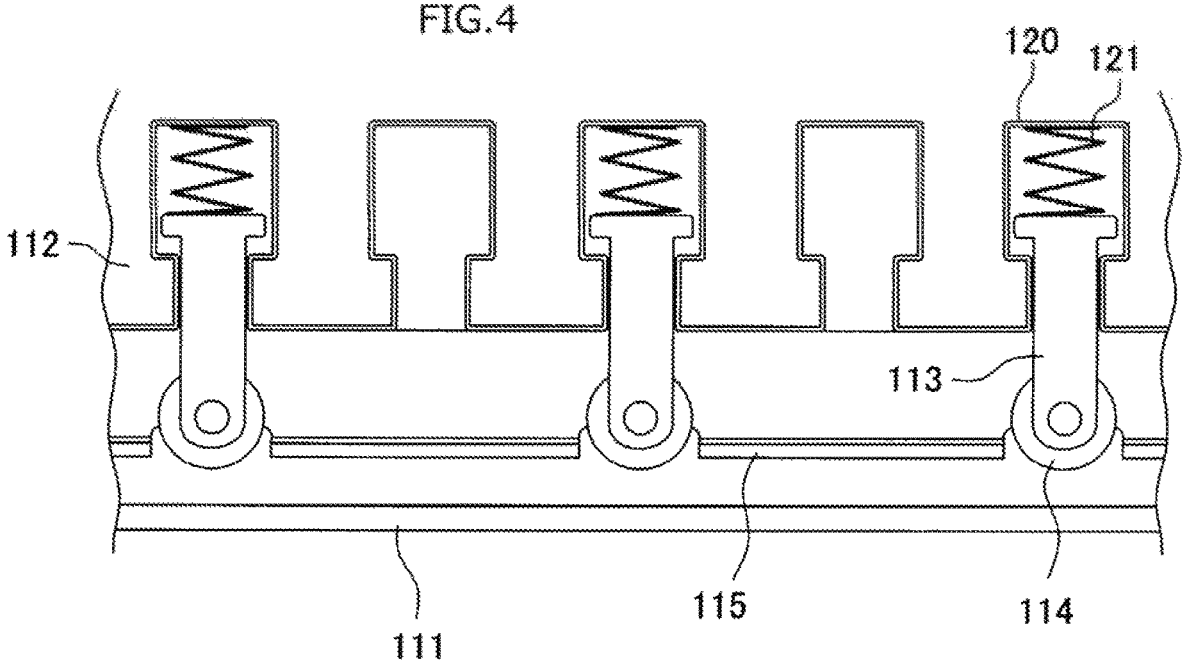
FIG. 4 is an explanatory view illustrating a mechanism provided inside the additional folding unit illustrated in FIG. 3 and configured to bias additional folding rollers to a sheet.

As illustrated in FIG. 4, it is preferable that the additional folding rollers 114 are each rotatably attached to an auxiliary member 113 movably supported with respect to the support member 112 and that a spring 121 is disposed as an elastic member between a spring receiving part 120 formed in the support member 112 and the upper end portion of each auxiliary member 113 so as to bias each of the additional folding rollers 114 toward the pedestal part of the lower folding guide 111. Thus, when the support member 112 of the additional folding unit 104 and the regulating member 115 attached thereto are moved downward toward the pedestal part of the lower folding guide 111, the additional folding rollers 114 stop their downward movement when contacting the pedestal part of the lower folding guide 111 through the sheet S. On the other hand, the support member 112 and the regulating member 115 can continue moving downward by the contraction of the spring 121 and can be stopped at the point of time when the distance between the bottom surface of the regulating member 115 and the upper surface of the pedestal part of the lower folding guide 111 becomes a desired value to make the regulating member 115 reach the regulating position. Further, the auxiliary member 113 is individually biased by the spring 121, so that even when the support member 112 is moved along the fold of the sheet S while being slightly inclined, the additional folding rollers 114 can apply a constant pressing force to the fold of the sheet S, preventing the sheets S from being unevenly folded due to a difference in pressure across the fold. Further, the additional folding rollers 114 can each be pressed against the sheet S by the compression of the spring 121 to thereby reliably apply pressing force to the fold of the sheet S.

The following describes the detailed configurations of the first moving mechanism 116 and second moving mechanism 117 in the illustrated embodiment.

The support member 112 of the additional folding unit 104 is vertically movably attached, through a bracket 125, to a slider 124 movable along a guide rail 123 fixed to a casing 122 or the like of the folding device B and is configured to be horizontally moved in conjunction with the slider 124. A rack 127 meshed with a pinion (not illustrated) rotated integrally with a pulley 126 is provided on the slider 124. When an additional folding drive motor 128 is driven, the rotation of the motor 128 is transmitted to the pulley 126 through a belt 129 to rotate the pulley 126, whereby the slider 124 can be moved horizontally along the guide rail 123.

Further, a cam groove 131 engaged with a contact piece 130 fixed to the casing 122 or the like of the folding device B is formed in the support member 112. With the horizontal movement of the support member 112, the cam groove 131 is moved while being engaged with the contact piece 130, and the support member 112 is moved while being guided following the shape of the cam groove 131. The cam groove 131 includes a first bottom horizontal part extending substantially horizontally, a first slope part extending from the end of the first bottom horizontal part while being inclined upward, a top horizontal part extending substantially horizontally from the end of the first slope part, a second slope part extending from the end of the top horizontal part while being inclined downward, and a second bottom horizontal part extending substantially horizontally from the end of the second slope part. When the support member 112 is moved horizontally in FIG. 3 relative to the casing 122 by the slider 124 with the first and second slope parts of the cam groove 131 engaged with the contact piece 130, the support member 112 is moved in a direction approaching or separating from the pedestal part of the lower folding guide 111, i.e., in the vertical direction in FIG. 3. As described above, the guide rail 123, slider 124, bracket 125, pulley 126, rack 127, additional folding drive motor 128, belt 129, contact piece 130, first and second slope parts of the cam groove 131 constitute the first moving mechanism 116. Further, when the support member 112 is moved horizontally in FIG. 3 relative to the casing 122 by the slider 124 with the top horizontal part of the cam groove 131 engaged with the contact piece 130, the support member 112 and the additional folding rollers 114 supported thereby are moved horizontally in FIG. 3 relative to the pedestal part of the lower folding guide 111 along the fold of the sheet S. As described above, the guide rail 123, slider 124, bracket 125, pulley 126, rack 127, additional folding drive motor 128, belt 129, contact piece 130 and the top horizontal part of the cam groove 131 constitute the second moving mechanism 117. Although, in the illustrated embodiment, the contact piece 130 is fixed to the casing 122 or the like, and the cam groove 131 is formed in the support member 112, it is needless to say that the contact piece 130 may be fixed to the support member 112, and the cam groove 131 may be formed in the casing 122.

When the additional folding rollers 114 are arranged so as to be separated from one another at equal intervals as in the illustrated embodiment, it is necessary to move the additional folding rollers 114 along the fold relative to the pedestal part of the lower folding guide 111 at the pressing position by a distance equal to or larger than the interval (i.e., distance corresponding to one pitch) between the two adjacent additional folding rollers 114 in order to press completely the fold positioned between the two adjacent additional folding rollers 114 by the additional folding rollers 114 and the pedestal part of the lower folding guide 111. In the configuration of the above-described first moving mechanism 116, the slider 124 is moved horizontally with the contact piece 130 and first slope part of the cam groove 131 engaged with each other to cause the additional folding rollers 114 supported by the support member 112 to approach the pedestal part of the lower folding guide 111 and then to reach the pressing position. In the configuration of the second moving mechanism 117, the slider 124 is moved horizontally with the contact piece 130 and the top horizontal part of the cam groove 131 engaged with each other to move the additional folding rollers 114 supported by the support member 112 along the fold at the pressing position. Thus, the length of the top horizontal part of the cam groove 131 in the horizontal direction (the direction along the fold) is equal to or larger than one pitch between the two adjacent additional folding rollers 114.

In the additional folding processing, when a sheet section (a part of the sheet S partitioned by the folds) is not interposed between the additional folding rollers 114 and the fold to allow the additional folding rollers 114 to directly face and contact the fold, the control part 140 controls the second moving mechanism 117 so as to move the additional folding rollers 114 disposed at the pressing position by the first moving mechanism 116 by a predetermined number of times N1 per one fold along the fold. On the other hand, when the sheet section is interposed between the additional folding rollers 114 and the fold, the control part 140 controls the second moving mechanism 117 so as to move the additional folding rollers 114 disposed at the pressing position by the first moving mechanism 116 by a predetermined number of times N2 larger than the number of times N1 for one fold along the fold. The number of times of the movement for one fold means that the entire fold is subjected to the additional folding processing by the movement of the support member 112 along the fold of the sheet S. Specifically, a one-way stroke of the engaged portion between the contact piece 130 and the cam groove 131 from one end to the other end or from the other end to one end of the top horizontal part of the cam groove 131 corresponds to the number of times of the movement for one fold.

When the additional folding rollers 114 disposed at the pressing position are repeatedly moved by the number of times N2 larger than the number of times N1 for one fold along the fold, the period of time during which the fold is applied with pressing force between the additional folding rollers 114 and the pedestal part of the lower folding guide 111 is increased, so that the total amount (workload) of the pressing force applied to the sheet section and the fold between the additional folding rollers 114 and the pedestal part of the lower folding guide 111 becomes larger than when the additional folding rollers 114 are moved along the fold by the number of times N1. When the sheet section is interposed between the additional folding rollers 114 and the fold, the pressing force is dispersed due to the presence of the sheet section to reduce the pressing force applied to the fold. However, when the additional folding rollers 114 are moved at the pressing position by the number of times N2 larger than the number of times N1 for one fold along the fold, the total amount (workload) of the pressing force applied to the sheet section and the fold between the additional folding rollers 114 and the pedestal part of the lower folding guide 111 is increased so as to cancel a reduction in the pressing force applied to the fold due to the presence of the sheet section interposed between the additional folding rollers 114 and the fold. Thus, it is possible to prevent the total amount of the pressing force applied to the fold when the sheet section is interposed between the additional folding rollers 114 and the fold from being reduced as compared to the total amount of the pressing force applied to the fold when the additional folding rollers 114 directly contact the fold. As a result, it is possible to prevent the effect of the additional folding from varying in accordance with the positional relationship among the additional folding roller, the fold and the sheet section and thus to make the folding height more uniform.

The following describes in detail the operations of the folding devices B and the additional folding unit 104 according to the illustrated embodiment with reference to FIGS. 5A to 5D, 6E to 6H, 7, 8A to 8C, and 9D to 9F. In the following description, it is assumed that folding processing is applied to a sheet S by the folding mechanism 103 in the manner as described above, and the folded sheet S is carried in the additional folding unit 104. The folded sheet S has three sheet sections partitioned by a first fold 132 and a second fold 133 and is Z-folded such that the first fold 132 and second fold 133 are positioned on the upper side and the lower side of the sheet section, respectively. Further, it is assumed that a thin sheet as a sheet S having a small weight and a thick sheet or a regular sheet as a sheet S having a large weight are carried in the additional folding unit 104.

Figure 5A:
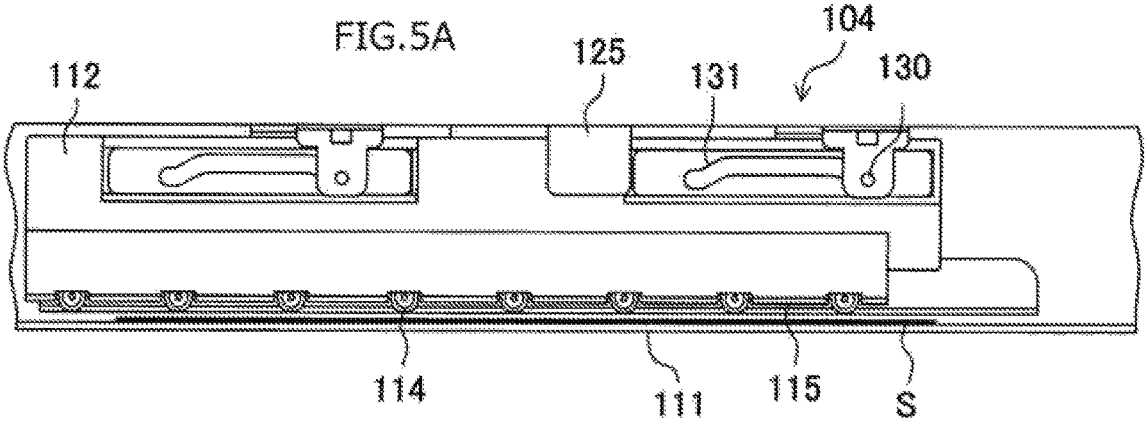

First, with reference to FIGS. 5A to 5D and 6E to 6H, the basic operation of folding processing with respect to the sheet S having a plurality of folds will be described. When the sheet S from the folding mechanism 103 is carried in the additional folding unit 104 through the carry-in port 119 and the carry-in path constituted by the upper carry-in guide 118*a* and lower carry-in guide 118*b*, the additional folding rollers 114 supported by the support member 112 are disposed at the reception position (home position), as illustrated in FIG. 5A. At this time, the lower end portions of the respective additional folding rollers 114 supported by the support member 112 regulate the upper side of the carry-in path, and the lower folding guide 111 regulates the lower side of the carry-in path, to thereby guide the first fold 132 of the carried-in sheet S between the additional folding rollers 114 and the lower folding guide 111. Further, at this time, the contact piece 130 is positioned at the end portion of the first bottom horizontal part of the cam groove 131. In the illustrated embodiment, a second retreat position to be described later corresponds to the reception position. However, the reception position may be set to any position different from the second retreat position as long as it is positioned closer to the retreat position (first retreat position or second retreat position) than to the pressing position, and the additional folding rollers 114 and the pedestal part of the lower folding guide 111 are separated from each other.

Figure 5B:
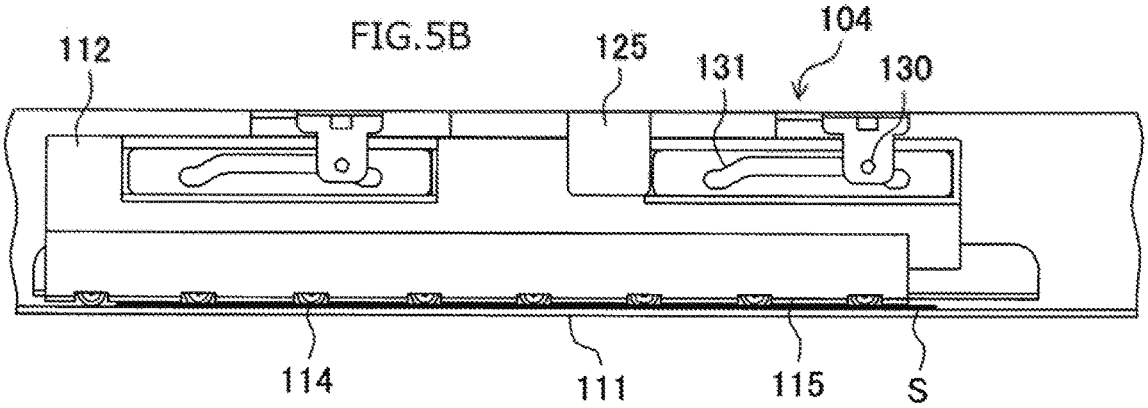

A sheet position detection means (not illustrated) provided upstream of the folding roller pair 105 is used to detect the position of the sheet S, and when it is recognized that the first fold 132 on the leading end side in the carry-in direction of the sheet S carried in the carry-in port 119 from the folding roller pair 105 has reached below the additional folding rollers 114, the conveyance of the sheet S is stopped, and the additional folding drive motor 128 is driven to horizontally move the support member 112 together with the slider 124 through the pinion integrally rotated with the pulley 126 and the rack 127. As a result, the engaged portion between the contact piece 130 and the cam groove 131 is moved from the first bottom horizontal part to the first slope part and, accordingly, the support member 112 is moved downward toward the pedestal part of the lower folding guide 111. Thus, as illustrated in FIG. 5B, the additional folding rollers 114 supported by the support member 112 are moved to the pressing position at which the first fold 132 of the sheet S is sandwiched and pressed between the additional folding rollers 114 and the pedestal part of the lower folding guide 111. At this time, one end portion (end portion on the upstream side in the moving direction of the additional folding rollers 114 in the forward traveling) of the first fold 132 of the sheet S is disposed between the two adjacent additional folding rollers 114 disposed at one outermost end, and the additional folding roller 114 disposed at the other outermost end is placed on the first fold 132 of the sheet S, with the result that the other end portion (end portion on the downstream side in the moving direction of the additional folding rollers 114 in the forward traveling) of the first fold 132 of sheet S is disposed outside the pressing member arrangement area (see FIG. 5B). In the state illustrated in FIG. 5B, one end portion of the first fold 132 of the sheet S is disposed at the intermediate position between the two adjacent additional folding rollers 114 disposed at one outermost end; however, the above phrase "between the two adjacent additional folding rollers 114 disposed at one outermost end" includes a position at which the pressing point of the additional folding roller 114 disposed at one outermost end coincides with one end portion of the first fold 132 of the sheet S. The auxiliary member 113 to which each additional folding roller 114 is attached is biased toward the lower folding guide 111 by the spring 121, so that even after the support member 112 is moved downward to make the additional folding rollers 114 abut against the pedestal part of the lower folding guide 111 through the sheet S, the support member 112 can be moved further downward. Accordingly, the regulating member 115 is also moved further downward to press the first fold 132 of the sheet S positioned below the additional folding rollers 114, thereby regulating the thickness of the first fold 132 of the sheet S to a value not greater than a predetermined thickness. Further, each additional folding roller 114 is biased by the spring 121 to press the first fold 132 of the sheet S toward the pedestal part of the lower folding guide 111. The "carry-in direction" in the present specification refers to a direction in which the sheet S from the folding roller pair 105 is carried in the additional folding unit 104 through the carry-in port 119.

Figure 5C:
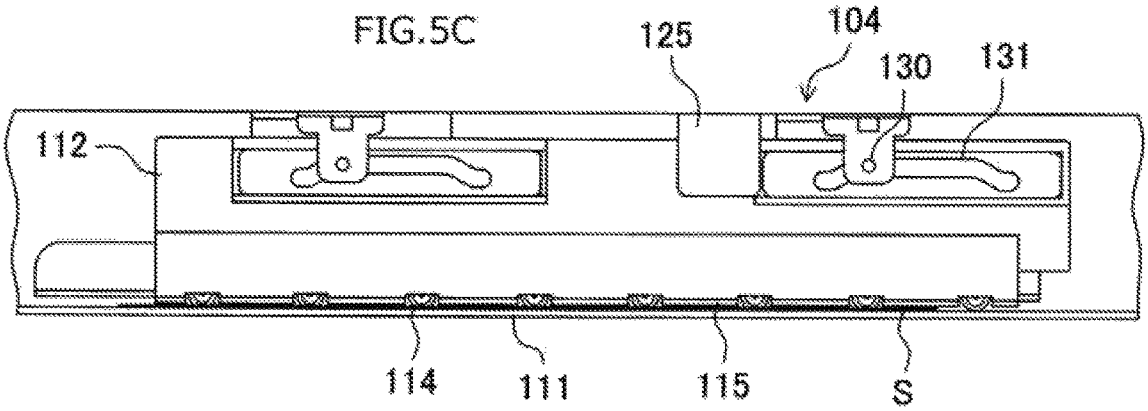

When the additional folding drive motor 128 is driven in the state illustrated in FIG. 5B to further horizontally move the support member 112 together with the slider 124, the engaged portion between the contact piece 130 and the cam groove 131 is moved from the first slope part to the top horizontal part, as illustrated in FIG. 5C. Then, the regulating member 115 attached to the support member 112 regulates the thickness of the first fold 132 of the sheet S to a predetermined thickness (corresponding to the distance d1) or less. At the same time, the additional folding rollers 114 supported by the support member 112 are moved at the pressing position along the first fold 132 of the sheet S relative to the pedestal part of the lower folding guide 111 by a distance equal to or larger than one pitch of the additional folding rollers 114, and the leading additional folding roller 114 in the moving direction thereof is moved to a position beyond the other end portion (end portion on the downstream side in the moving direction of the additional folding rollers 114 in the forward traveling) of the first fold 132 of the sheet S. More specifically, the other end portion of the first fold 132 of the sheet S is disposed between the two adjacent additional folding rollers 114 disposed at the other outermost end, and the additional folding roller 114 disposed at one outermost end is placed on the first fold 132 of the sheet S, with the result that one end portion (end portion on the upstream side in the moving direction of the additional folding rollers 114 in the forward traveling) of the first fold 132 of the sheet S is disposed outside the pressing member arrangement area (see FIG. 5C). In the state illustrated in FIG. 5C, the other end portion of the first fold 132 of the sheet S is disposed at the intermediate position between the two adjacent additional folding rollers 114 disposed at the other outermost end; however, the above phrase "between the two adjacent additional folding rollers 114 disposed at the other outermost end" includes a position at which the pressing point of the additional folding roller 114 disposed at the other outermost end coincides with the other end portion of the first fold 132 of the sheet S. In this manner, the first fold 132 is pressed over the entire area thereof by the additional folding rollers 114 and the pedestal part of the lower folding guide 111, whereby strengthening (additional folding) of the first fold 132 is achieved.

Figure 5D:
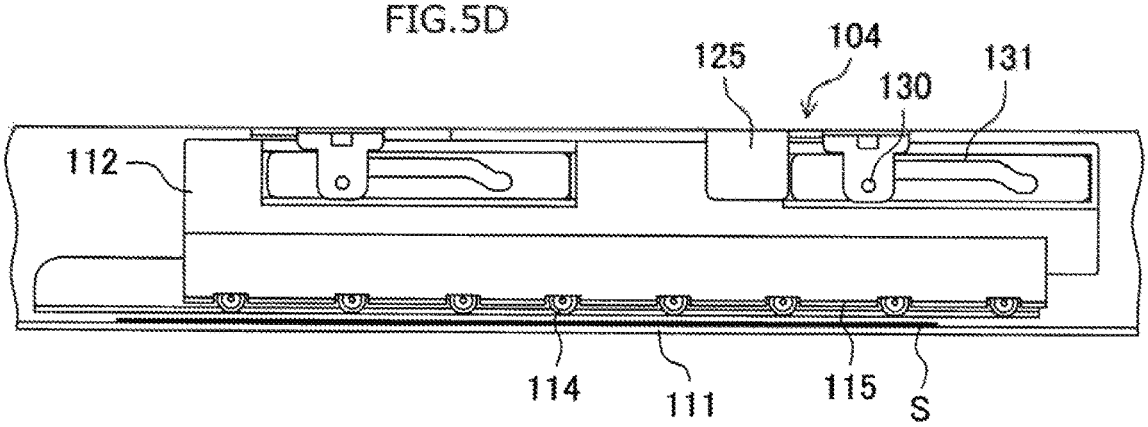

When the additional folding drive motor 128 is driven in the state illustrated in FIG. 5C to further horizontally move the support member 112 together with the slider 124, the engaged portion between the contact piece 130 and cam groove 131 is moved from the top horizontal part to second bottom horizontal part through the second slope part. Thus, as illustrated in FIG. 5D, the support member 112 is moved upward together with the regulating member 115 in a direction separating from the pedestal part of the lower folding guide 111 to reach the first retreat position above and near a position at which the additional folding rollers 114 supported by the support member 112 end their pressing operation, whereby first additional folding processing is completed. The first retreat position differs from the reception position (home position).

When the first additional folding processing is completed, coming to the state illustrated in FIG. 5D, it becomes possible for the sheet S to be conveyed by the conveying roller pair 102 and folding roller pair 105 which are positioned on the upstream side in the carry-in direction. Then, in the state illustrated in FIG. 5D, the sheet S is conveyed by the conveying roller pair 102 and the folding roller pair 105, and the position of the sheet S is detected by the sheet position detection means provided upstream of the folding roller pair 105. Then, when it is recognized that the second fold 133 positioned on the rear end side in the carry-in direction relative to the first fold 132 has reached below the additional folding rollers 114, the conveyance of the sheet S is stopped.

Figure 6E:
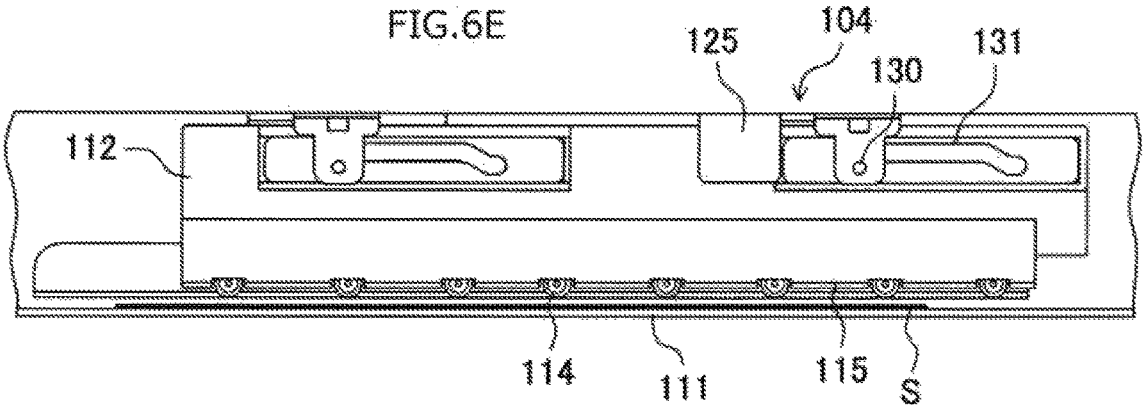
Figure 6F:
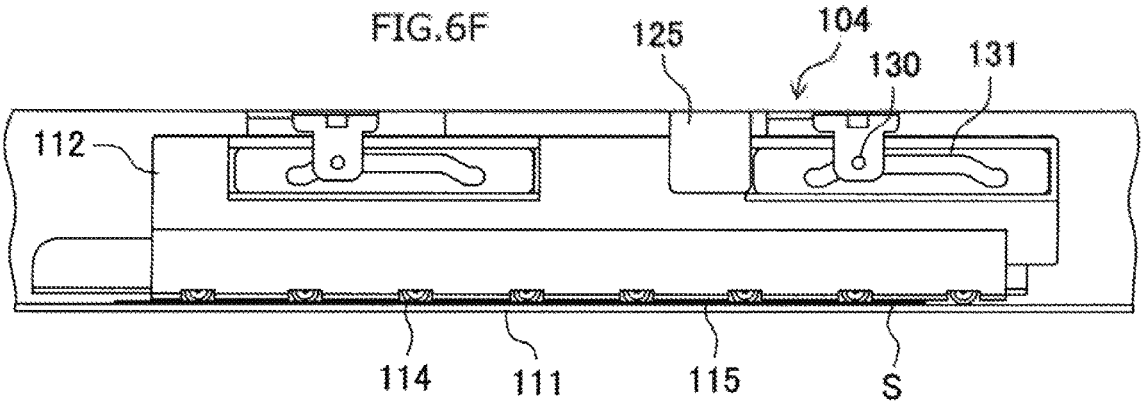

When the second fold 133 of the sheet S is stopped below the additional folding rollers 114 (see FIG. 6E), the additional folding drive motor 128 is driven so as to be rotated in the direction opposite to the rotation direction in the forward traveling, to thereby horizontally move the support member 112 together with the slider 124 through the pinion integrally rotated with the pulley 126 and rack 127 in the direction opposite to the moving direction in the forward traveling. As a result, the engaged portion between the contact piece 130 and the cam groove 131 is moved from the second bottom horizontal part to the second slope part and, accordingly, the support member 112 is moved downward toward the pedestal part of the lower folding guide 111. Thus, as illustrated in FIG. 6F, the additional folding rollers 114 supported by the support member 112 are moved to the pressing position at which the second fold 133 of the sheet S is sandwiched and pressed between the additional folding rollers 114 and the pedestal part of the lower folding guide 111. The position of each of the additional folding rollers 114 at this time, i.e., the position of the start point of the backward traveling coincides with the position of the end point of the forward traveling. At this time, one end portion (end portion on the upstream side in the moving direction of the additional folding rollers 114 in the backward traveling) of the second fold 133 of the sheet S is disposed between the two adjacent additional folding rollers 114 disposed at one outermost end, and the additional folding roller 114 disposed at the other outermost end is placed on the second fold 133 of the sheet S, with the result that the other end portion (end portion on the downstream side in the moving direction of the additional folding rollers 114 in the backward traveling) of the second fold 133 of the sheet S is disposed outside the pressing member arrangement area (see FIG. 6F). The auxiliary member 113 to which each additional folding roller 114 is attached is biased toward the pedestal part of the lower folding guide 111 by the spring 121, so that even after the support member 112 is moved downward to make the additional folding rollers 114 abut against the pedestal part of the lower folding guide 111 through the sheet S, the support member 112 can be moved further downward. Accordingly, the regulating member 115 is also moved further downward to press the sheet section and second fold 133 of the sheet S positioned below the additional folding rollers 114, thereby regulating the thickness of the sheet section and second fold 133 of the sheet S to a value not greater than a predetermined thickness. Further, each additional folding roller 114 is biased by the spring 121 to press the sheet section and second fold 133 of the sheet S toward the pedestal part of the lower folding guide 111.

Figure 6G:
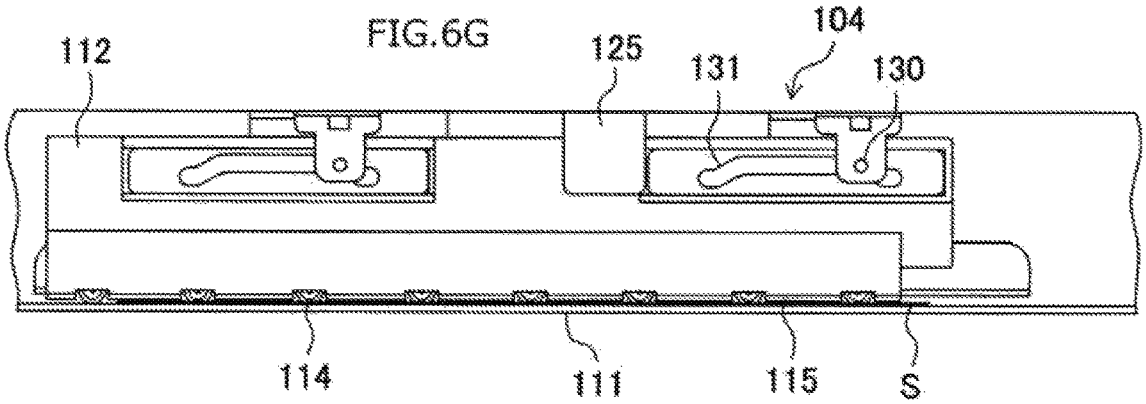

When the additional folding drive motor 128 is driven in the state illustrated in FIG. 6F to further horizontally move the support member 112 together with the slider 124 in the direction opposite to the moving direction in the forward traveling, the engaged portion between the contact piece 130 and the cam groove 131 is moved from the second slope part to the top horizontal part, as illustrated in FIG. 6G. Then, the regulating member 115 attached to the support member 112 regulates the thickness of the sheet section and second fold 133 of the sheet S positioned below the additional folding rollers 114 to a value not greater than a predetermined thickness (corresponding to the distance d1). At the same time, the additional folding rollers 114 supported by the support member 112 are moved at the pressing position along the second fold 133 of the sheet S relative to the pedestal part of the lower folding guide 111 in the direction opposite to the moving direction in the forward traveling by a distance equal to or larger than one pitch of the additional folding rollers 114, and the leading additional folding roller 114 in the moving direction thereof is moved to a position beyond the end portion of the second fold 133 of the sheet S. In this manner, the second fold 133 is pressed over the entire area thereof by the additional folding rollers 114 and the pedestal part of the lower folding guide 111, whereby strengthening (additional folding) of the second fold 133 is achieved.

Figure 6H:
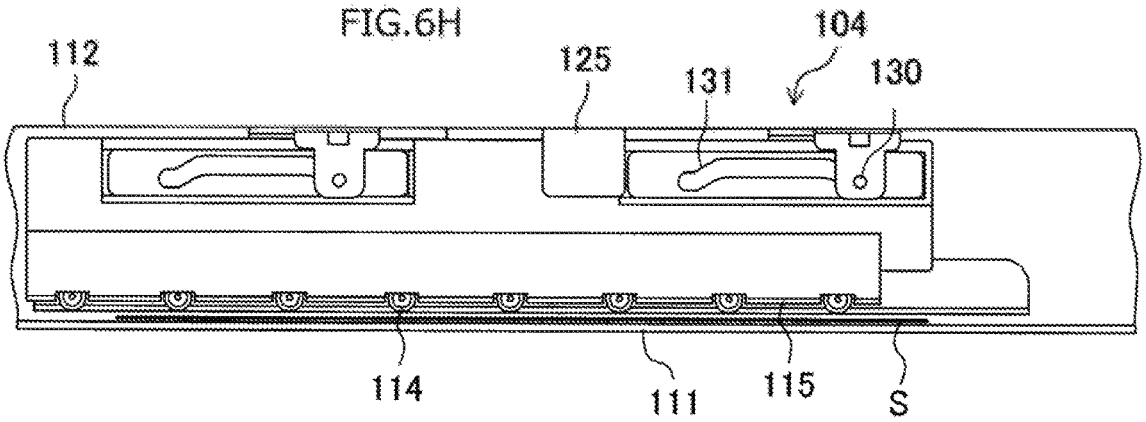
Figure 7:
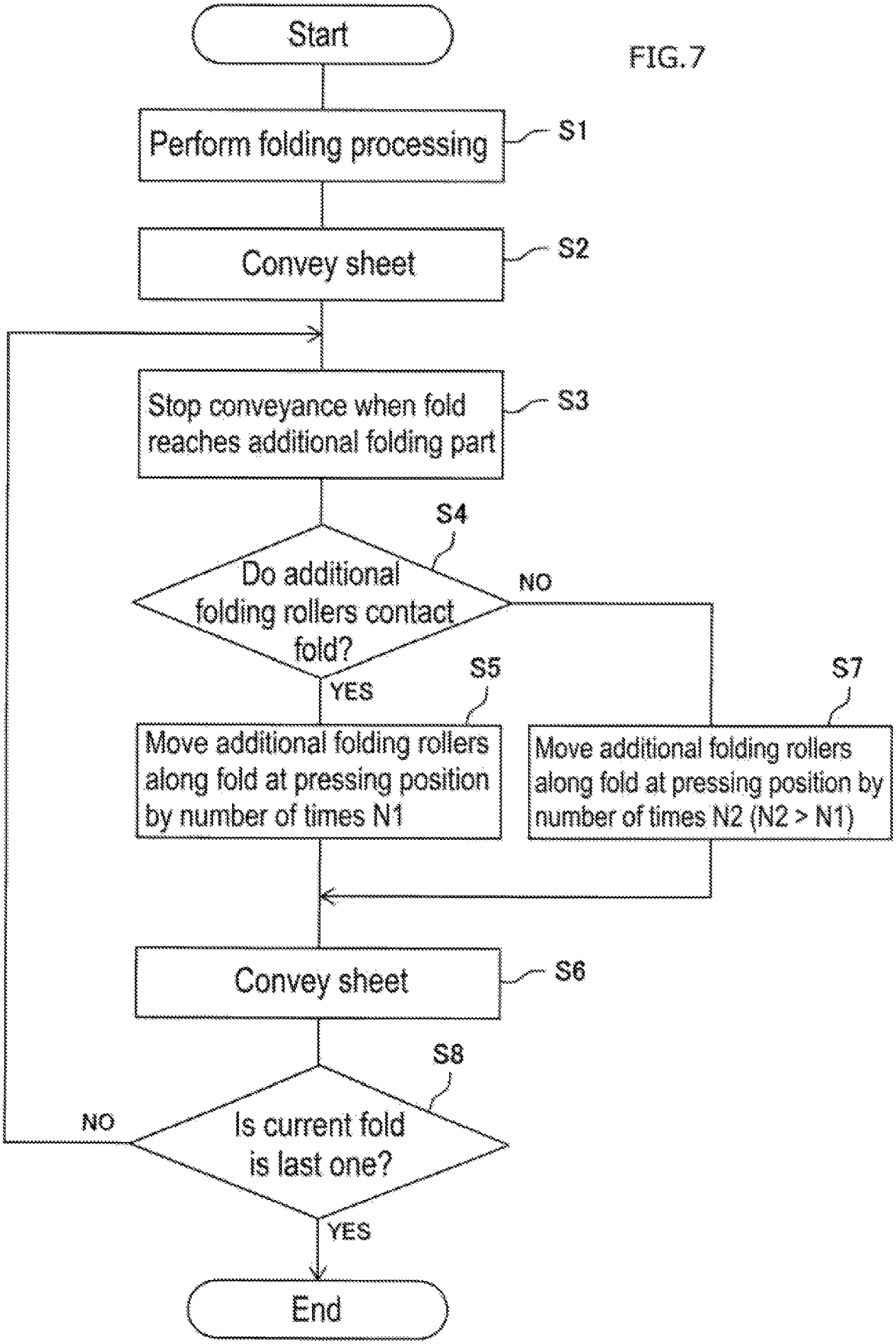
FIG. 7 is a flowchart illustrating the operation of the folding device illustrated in FIG. 1.

When the additional folding drive motor 128 is driven in the state illustrated in FIG. 6G to further horizontally move the support member 112 together with the slider 124 in the direction opposite to the moving direction in the forward traveling, the engaged portion between the contact piece 130 and the cam groove 131 is moved from the top horizontal part to the first bottom horizontal part through the first slope part. Thus, as illustrated in FIG. 6H, the support member 112 is moved upward together with the regulating member 115 in a direction separating from the pedestal part of the lower folding guide 111 to reach the second retreat position near a position at which the additional folding rollers 114 supported by the support member 112 end their pressing operation, whereby second additional folding processing is completed. In the present embodiment, the second retreat position is set at the same position as the reception position (home position). However, the second retreat position may be set at a position different from the reception position.

After thus completing a series of operations for additional folding, the sheet S is conveyed toward the post-processing device C on the downstream side by the conveying roller pair 102 and the folding roller pair 105 which are positioned on the upstream side in the carry-in direction. The lower end portions of the additional folding rollers 114 and the bottom surface of the regulating member 115 at the retreat position function also as a guide for discharging the sheet S that has been subjected to the additional folding.

In the additional folding unit 104, when the additional folding rollers 114 are moved relative to the pedestal part of the lower folding guide 111 by the first moving mechanism 116 from the retreat position or reception position to the pressing position, one end portion (end portion on the upstream side in the moving direction along the fold) of the fold of the sheet S is disposed between the two adjacent additional folding rollers 114 positioned at one outermost end of the pressing member arrangement area, and the other end portion (end portion on the downstream side in the moving direction along the fold) of the fold is disposed outside (i.e., outside of the additional folding roller 114 positioned at the other outermost position of the pressing member arrangement area) of the pressing member arrangement area. When the additional folding rollers 114 are arranged so as to be separated from one another at equal intervals in the moving direction thereof along the fold, it is necessary to move the additional folding rollers 114 along the fold by a distance equal to or larger than the interval (i.e., distance corresponding to one pitch) between the two adjacent additional folding rollers 114 in order to press completely the fold positioned between the two adjacent additional folding rollers 114 by the additional folding rollers 114 and the pedestal part of the lower folding guide 111. Thus, when the additional folding rollers 114, i.e., support member 112 is moved along the fold by a distance equal to or larger than one pitch of the additional folding rollers 114, which is the minimum distance required for achieving additional folding processing, the additional folding roller 114 at the outermost end on the upstream side in the moving direction along the fold goes beyond the end portion of the sheet S on the upstream side in the moving direction and is reliably moved to the position of the additional folding roller 114 adjacent to the additional folding roller 114 at the outermost end on the upstream side in the moving direction at the starting period of the movement, with the result that the end portion of the sheet S positioned, at the starting period, between the two adjacent additional folding rollers 114 at the outermost end on the upstream side in the moving direction at the starting period of the movement is pressed (additionally folded).

Further, with the movement of the additional folding rollers 114 along the fold, the additional folding unit 104 performs additional folding of a first fold in the forward traveling and performs additional folding of a second fold in the backward traveling when a plurality of folds are formed in one sheet S (as in a Z-folded sheet or an inwardly three-folded sheet). Thus, it is possible to apply additional folding processing to a plurality of folds by pressing different folds in the forward traveling and backward traveling. That is, it is possible to apply additional folding processing to a plurality of folds efficiently in short times while suppressing an increase in time required for the additional folding processing.

In the above description, the additional folding unit 104 applies additional folding processing to the Z-folded sheet; however, the additional folding unit 104 can accommodate itself to a two-folded sheet, a four-folded sheet and the like. In a case where only one fold is formed in one sheet like a two-folded sheet, additional folding processing is first applied to the fold of a preceding sheet in the forward traveling, and after the discharge of the preceding sheet, additional folding processing is applied to the fold of the succeeding sheet in the backward traveling, whereby additional folding processing can be efficiently applied to successively conveyed sheets in short times. Further, in a case where three or more folds are formed in one sheet like a four-folded sheet, the conveyance of the sheet is stopped every time the fold reaches below the additional folding rollers 114, and the additional folding rollers 114 are moved along the fold in the forward traveling or backward traveling to perform additional folding processing. In addition, the target of the folding processing may be a sheet bundle or a single sheet. The sheet bundle may be a bound sheet bundle or a sheet bundle that is not bound.

The following describes in detail the control performed by the control part 140 of the folding device B for the additional folding processing illustrated in FIGS. 5A to 5D and 6E to 6H, especially, control of the second moving mechanism 117, with reference to FIGS. 7, 8A to 8C, and 9D to 9F. Hereinafter, as illustrated in FIGS. 8A to 8C and 9D to 9F, it is assumed that a Z-folded sheet S in which the first fold 132 and the second fold 133 are positioned on the upper side and the lower side of the sheet section, respectively, is carried in the additional folding unit 104.

First, in the folding device B, the folding mechanism 103 applies folding processing to the sheet S to fold the sheet S in a Z-shape such that the first fold 132 and the second fold 133 are positioned on the upper side and the lower side of the sheet section, respectively (step S1). More specifically, when recognizing that the leading end of the sheet S is nipped by the folding roller pair 105, the control part 140 controls, in order to form a folded part in the sheet, the folding mechanism 103 to horizontally move the push plate 107 to a retreat position below the lower conveying guide 109 to thereby form a space for forming a loop between the lower conveying guide 109 and the lower folding guide 111. The loop forming space is thus formed, and then the sheet S is conveyed by a predetermined amount with the leading end thereof nipped by the folding roller pair 105. Then, the intermediate portion of the sheet S is bent downward in the loop forming space to form a loop part in the sheet S. In this state, the push plate 107 is horizontally moved from the retreat position toward the folding roller pair 105 to form a folded part and, after the push plate 107 has almost reached the folding roller pair 105, the folding roller pair 105 is driven to convey the sheet S, whereby the first fold 132 is formed. Subsequently, the push plate 107 is moved to the retreat position, and then the sheet S is conveyed by the folding roller pair 105 to nip the loop part, whereby the second fold 133 is formed, and the thus Z-folded sheet S is conveyed downstream.

Figure 8A:
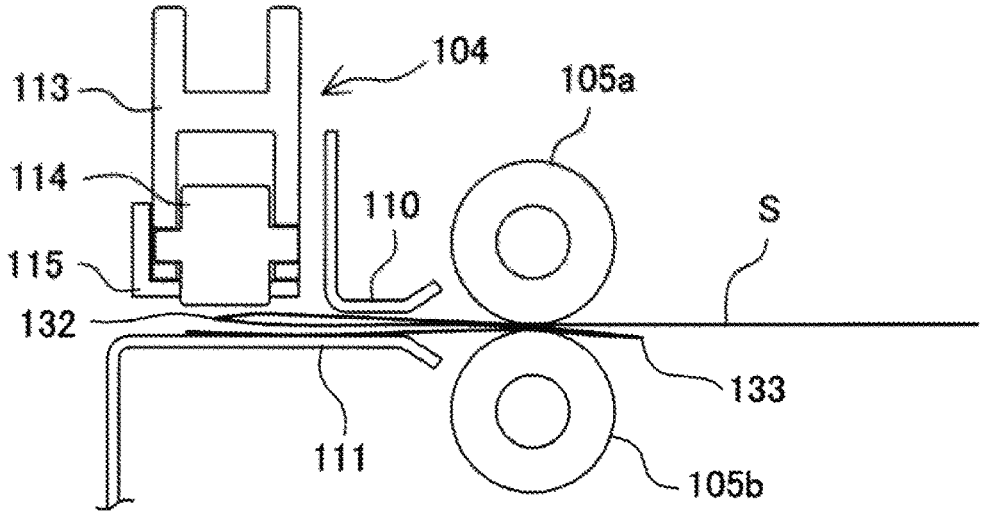

The sheet S thus subjected to folding processing by the folding mechanism 103 is carried in the additional folding unit 104 through the carry-in port 119 by the folding roller pair 105 (step S2). The additional folding unit 104 receives therein the sheet S in a state where the additional folding rollers 114 are disposed at the retreat position or reception position separated toward the retreat position side from the pedestal part of the lower folding guide 111 away more than the pressing position is. At this time, the control part 140 stops the sheet S when recognizing that the first fold 132 on the leading end side in the carry-in direction of the sheet S carried in the carry-in port 119 from the folding roller pair 105 has reached the additional folding part, i.e., below the additional folding rollers 114 as illustrated in FIG. 8A from the position of the sheet S detected by a sheet position detection means (not illustrated) provided upstream of the folding roller pair 105 (step S3).

Figure 8B:
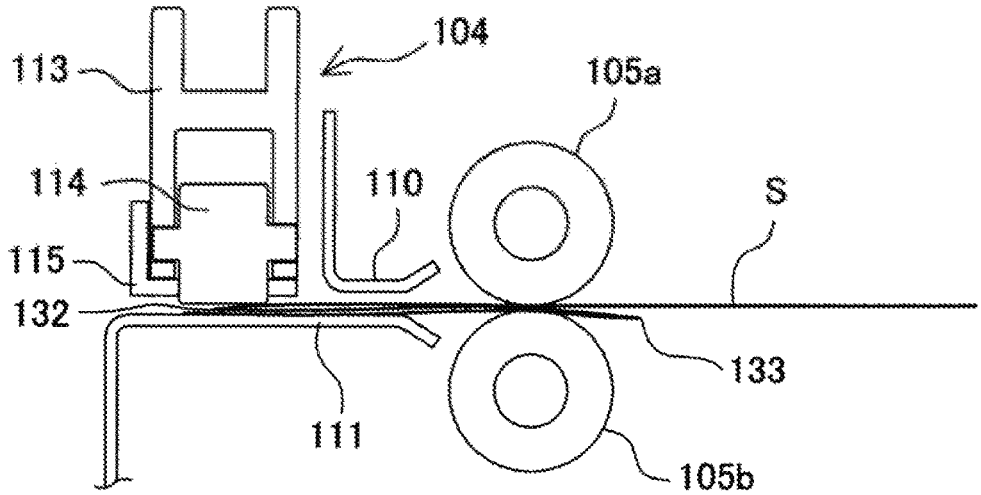

When the first fold 132 is stopped at the additional folding part, the control part 140 drives the first moving mechanism 116 to move the additional folding rollers 114 supported by the support member 112 to the pressing position. After that, the control part 140 drives the second moving mechanism 117 to move the additional folding rollers 114 relative to the pedestal part of the lower folding guide 111 along the first fold 132 at the pressing position to make the additional folding rollers 114 and the pedestal part of the lower folding guide 111 press the first fold 132 and thus strengthen (additionally fold) the first fold 132, as illustrated in FIG. 8B.

When moving the additional folding rollers 114 along the fold at the pressing position as described above, the control part 140 controls the operation of the second moving mechanism 117 to change the number of times the additional folding rollers 114 are moved along the fold for one fold according to whether the additional folding rollers 114 can directly contact the fold, i.e., whether the sheet section is interposed between the additional folding rollers 114 and the fold (step S4).

When the fold is positioned on the upper side of the sheet section as in the case of the first fold 132 of the sheet S on the leading end side in the conveying direction of the sheet S to allow the additional folding rollers 114 to directly contact the fold, the control part 140 controls the operation of the second moving mechanism 117 to move the additional folding rollers 114 relative to the pedestal part of the lower folding guide 111 along the first fold 132 at the pressing position by a predetermined number of times N1 for one fold (step S5). More specifically, the control part 140 drives the additional folding drive motor 128 to horizontally move the support member 112 together with the slider 124 to repeat, by the number of times N1, the one-way stroke between one and the other end portions of the top horizontal part of the cam groove 131 relative to the contact piece 130 to move the additional folding rollers 114 relative to the pedestal part of the lower folding guide 111 along the first fold 132 at the pressing position by the number of times N1, thereby applying additional folding processing to the first fold 132.

Figure 8C:
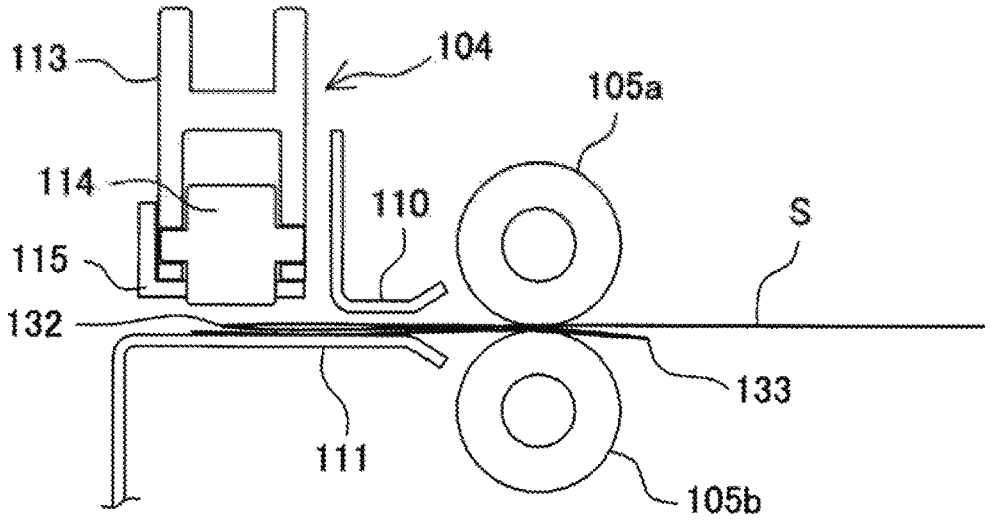

As illustrated in FIG. 8C, after completion of the additional folding processing for the first fold 132, the control part 140 controls the operation of the first moving mechanism 116 to move upward the additional folding rollers 114 supported by the support member 112 toward the retreat position in a direction separating from the pedestal part of the lower folding guide 111 by a predetermined distance and conveys the sheet S downstream (step S6).

Figure 9D:
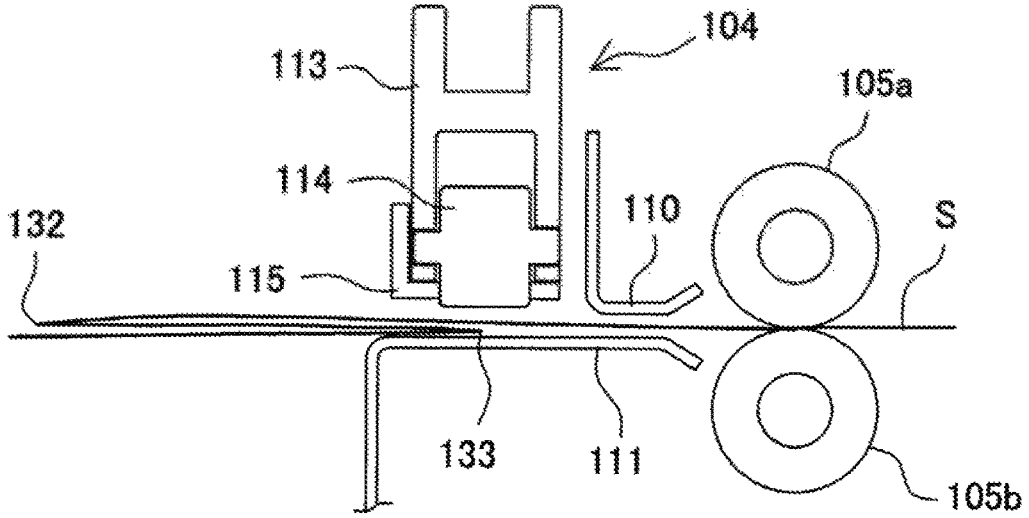

The sheet S whose first fold 132 has been subjected to the additional folding processing is thus conveyed and, as in the case of the additional folding processing for the first fold 132, the control part 140 stops the sheet S when recognizing that the second fold 133 has reached the additional folding part as illustrated in FIG. 9D from the position of the sheet S detected by a sheet position detection means (not illustrated) provided upstream of the folding roller pair 105 (step S3).

Figure 9E:
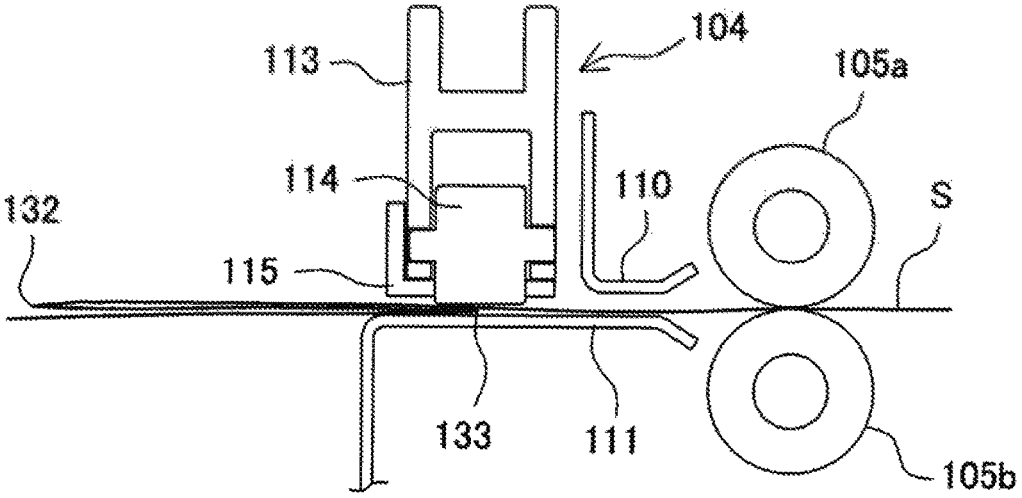

As in the case of the additional folding processing for the first fold 132, when the second fold 133 is stopped at the additional folding part, the control part 140 controls the operation of the first moving mechanism 116 to move the additional folding rollers 114 supported by the support member 112 to the pressing position as illustrated in FIG. 9E. Thereafter, the control part 140 controls the operation of the second moving mechanism 117 to move the additional folding rollers 114 relative to the pedestal part of the lower folding guide 111 along the second fold 133 at the pressing position to make the additional folding rollers 114 and the pedestal part of the lower folding guide 111 press the second fold 133 and thus strengthen (additionally fold) the second fold 133.

As in the case of the additional folding processing for the first fold 132, when moving the additional folding rollers 114 along the fold at the pressing position, the control part 140 controls the operation of the second moving mechanism 117 to change the number of times the additional folding rollers 114 are moved along the fold for one fold according to whether the additional folding rollers 114 can directly contact the fold, i.e., whether the sheet section is interposed between the additional folding rollers 114 and the fold (step S4).

When the fold is positioned on the lower side of the sheet section as in the case of the second fold 133 of the sheet S on the rear end side in the conveying direction of the sheet S to make the sheet section be interposed between the additional folding rollers 114 and the fold, the control part 140 controls the operation of the second moving mechanism 117 to move the additional folding rollers 114 supported by the support member 112 relative to the pedestal part of the lower folding guide 111 along the second fold 133 at the pressing position by a predetermined number of times N2 larger than the number of times N1 for one fold (step S7). More specifically, the control part 140 drives the additional folding drive motor 128 to horizontally move the support member 112 together with the slider 124 to repeat, by the number of times N2, the one-way stroke between one and the other end portions of the top horizontal part of cam groove 131 relative to the contact piece 130 to move the additional folding rollers 114 relative to the pedestal part of the lower folding guide 111 along the second fold 133 at the pressing position by the number of times N2, thereby applying additional folding processing to the second fold 133.

When the sheet section is interposed between the additional folding rollers 114 and the fold, the pressing force is dispersed due to the presence of the sheet section to reduce the pressing force applied to the fold. However, when the additional folding rollers 114 are moved at the pressing position by the number of times N2 larger than the number of times N1 for one fold along the second fold 133, the period of time during which the sheet section and the second fold 133 are applied with pressing force between the additional folding rollers 114 and the pedestal part of the lower folding guide 111 is elongated to increase the total amount (workload) of the pressing force applied to the sheet section and the second fold 133 between the additional folding rollers 114 and the pedestal part of the lower folding guide 111. Thus, a reduction in the pressing force applied to the fold due to the presence of the sheet section interposed between the additional folding rollers 114 and the fold is canceled by an increase in the total amount of the pressing force applied to the sheet section and the second fold 133 due to an increase in the number of times of the movement of the additional folding rollers 114 along the second fold 133. As a result, it is possible to prevent the total amount of the pressing force applied to the second fold 133 when the sheet section is interposed between the additional folding rollers 114 and the second fold 133 from being reduced as compared to the total amount of the pressing force applied when the additional folding rollers 114 directly contact the first fold 132. This makes it possible to prevent the effect of the additional folding from varying in accordance with the positional relationship among the additional folding rollers 114, the second fold 133 and the sheet section and thus to make the folding height more uniform.

Further, in steps S5 and S7, when the sheet section is interposed between the additional folding rollers 114 and the fold, the control part 140 may control the operation of the second moving mechanism 117 so as to make the number of times the additional folding rollers 114 are moved along the second fold 133 at the pressing position larger when the weight of the sheet S acquired by the sheet weight detection sensor 141 is equal to or larger than a predetermined threshold value $\alpha$ than when the weight of the sheet S acquired by the sheet weight detection sensor 141 is smaller than the predetermined threshold value $\alpha$. This increases the period of time during which the sheet section and the second fold 133 are pressed between the additional folding rollers 114 and the pedestal part of the lower folding guide 111 to increase the total amount (workload) of the pressing force applied to the second fold 133. As a result, the effect of strengthening the fold is increased when the sheet S is a sheet having a weight equal to or larger than a predetermined threshold value and thus difficult to fold, like a thick sheet. Thus, it is possible to make the folding height more uniform irrespective of the weight of the sheet. When the weight of the sheet S acquired by the sheet weight detection sensor 141 is equal to or larger than a predetermined threshold value $\alpha$, the control part 140 may control the operation of the second moving mechanism 117 so as to increase the number of times the additional folding rollers 114 are moved along the fold at the pressing position as compared to when the weight of the sheet S acquired by the sheet weight detection sensor 141 is smaller than the predetermined threshold value $\alpha$ not only when the sheet section is interposed between the additional folding rollers 114 and the fold, but also when the additional folding rollers 114 directly contact the fold.

Further, in addition to the control of the number of times of the movement along the fold, the control part 140 may control the second moving mechanism 117 so as to make lower the speed of the movement of the additional folding rollers 114 disposed at the pressing position along the fold when the pressing force is applied to the fold between the additional folding rollers 114 and the pedestal part of the lower folding guide 111 with the sheet section interposed between the additional folding rollers 114 and the fold as in the case of the additional folding processing for the second fold 133 in step S7 than when the pressing force is applied with the additional folding rollers 114 directly contacting the fold as in the case of the additional folding processing for the first fold 132 in step S5. This increases the period of time during which the second fold 133 is pressed between the additional folding rollers 114 and the pedestal part of the lower folding guide 111 to increase the total amount of the pressing force applied to the second fold 133. Thus, a reduction in the pressing force applied to the fold due to the presence of the sheet section interposed between the additional folding rollers 114 and the fold is canceled also by an increase in the total amount of the pressing force applied to the sheet section and the second fold 133 due to a reduction in the speed of the movement of the additional folding rollers 114 along the second fold 133. As a result, it is possible to further prevent the total amount of the pressing force applied to the second fold 133 when the sheet section is interposed between the additional folding rollers 114 and the second fold 133 from being reduced as compared to the total amount of the pressing force applied when the additional folding rollers 114 directly contact the first fold 132. This makes it possible to further prevent the effect of the additional folding from varying in accordance with the positional relationship among the additional folding rollers 114, the second fold 133 and the sheet section and thus to make the folding height more uniform irrespective of the positional relationship among the additional folding rollers, the fold and the sheet section.

Further, in addition to the control of the number of times of the movement along the fold, the control part 140 may control the first moving mechanism 116 so as to make stronger the pressing force applied to the sheet section and the fold between the additional folding rollers 114 and the pedestal part of the lower folding guide 111 when the pressing force is applied with the sheet section interposed between the additional folding rollers 114 and the fold as in the case of the additional folding processing for the second fold 133 than when the additional folding rollers 114 directly face and contact the fold. This further increases the total amount of the pressing force applied to the fold between the additional folding rollers 114 and the pedestal part of the lower folding guide 111. As a result, it is possible to further prevent the total amount of the pressing force applied to the second fold 133 when the sheet section is interposed between the additional folding rollers 114 and the second fold 133 from being reduced as compared to the total amount of the pressing force applied when the additional folding rollers 114 directly contact the first fold 132. This makes it possible to further prevent the effect of the additional folding from varying in accordance with the positional relationship among the additional folding rollers 114, the second fold 133 and the sheet section and thus to make the folding height more uniform irrespective of the positional relationship among the additional folding roller, the fold and the sheet section.

Figure 9F:
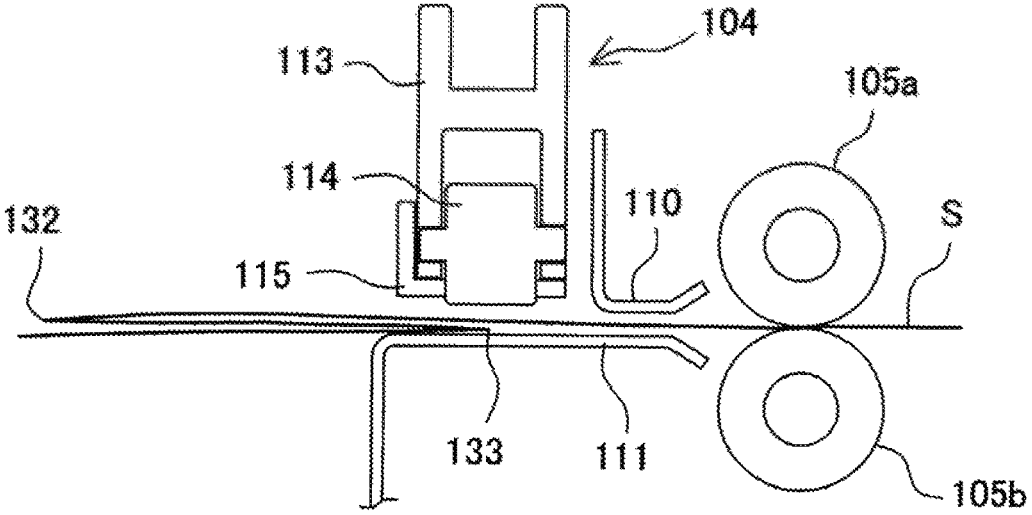
Figure 10:
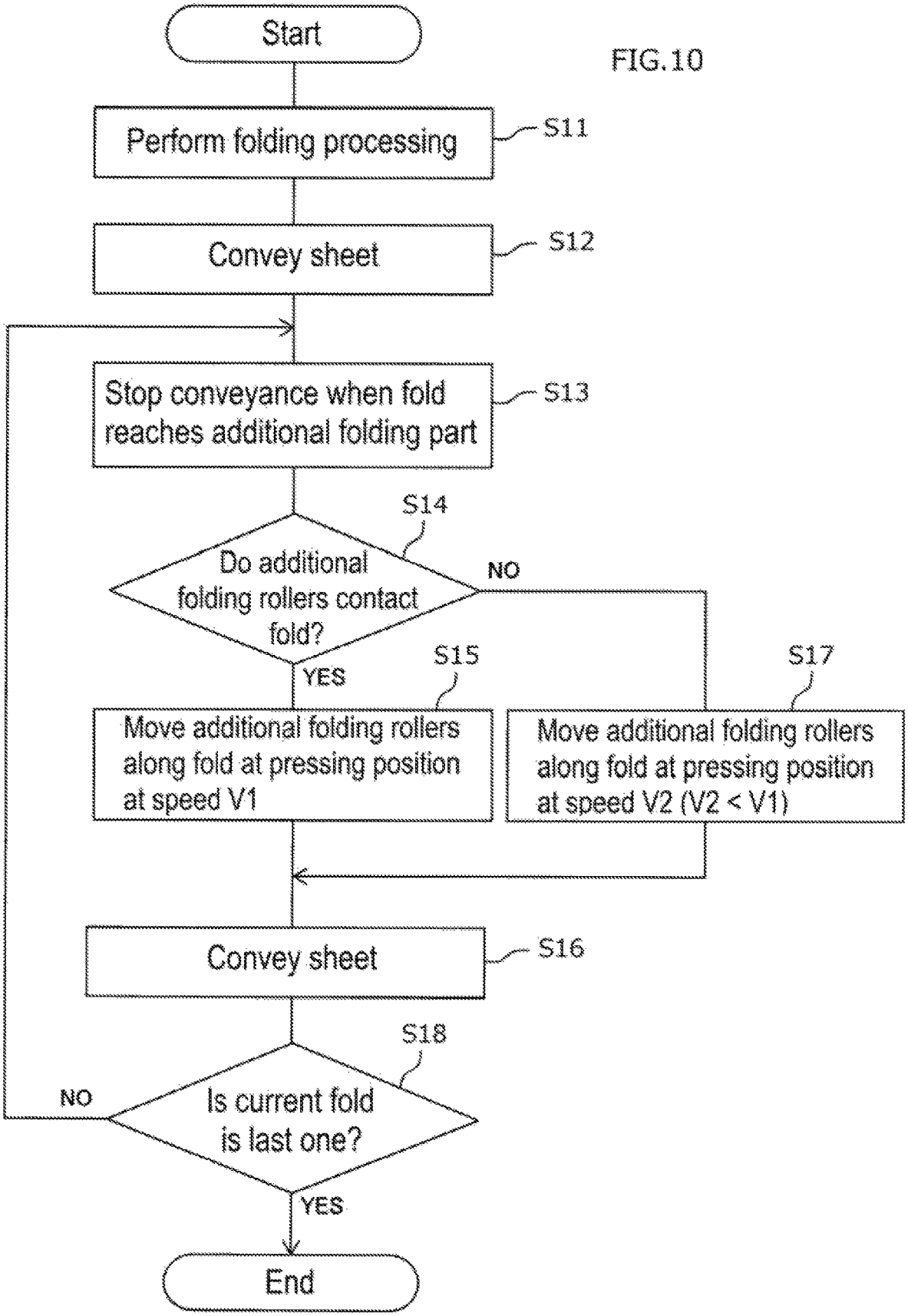
FIG. 10 is a flowchart illustrating the operation according to a second embodiment of the folding device illustrated in FIG. 1.

As in the case of the additional folding processing for the first fold 132, after completion of the additional folding processing for the second fold 133, the control part 140 controls the first moving mechanism 116 to move upward the additional folding rollers 114 supported by the support member 112 toward the retreat position in a direction separating from the pedestal part of the lower folding guide 111 by a predetermined distance and conveys the sheet S downstream, as illustrated in FIG. 9F (step S6).

When two or more folds are formed in one sheet like a Z-folded sheet, a three-folded sheet or the like, the operations from step S3 to step S7 are repeated until additional folding processing for the last fold is completed (step S8). That is, every time the fold of the sheet S is disposed at the additional folding part, the conveyance of the sheet S is stopped, and the additional folding rollers 114 are moved along the fold of the sheet S to perform additional folding processing. After completion of the additional folding processing for all folds, the sheet S that has been subjected to the additional folding processing is conveyed to the post-processing device C.

Second Embodiment

In the second embodiment, in additional folding processing, the control part 140 controls the second moving mechanism 117 so as to move the additional folding rollers 114 disposed at the pressing position by the first moving mechanism 116 along the fold at a predetermined speed V1 when the sheet section (a part of the sheet S partitioned by the folds) is not interposed between the additional folding rollers 114 and the fold to allow the additional folding rollers 114 to directly face and contact the fold. On the other hand, when the sheet section is interposed between the additional folding rollers 114 and the fold, the control part 140 controls the second moving mechanism 117 so as to move the additional folding rollers 114 disposed at the pressing position by the first moving mechanism 116 along the fold at a speed V2 lower than the speed V1.

When the additional folding rollers 114 disposed at the pressing position are moved along the fold at the speed V2 lower than the speed V1, the period of time during which the fold is applied with pressing force between the additional folding rollers 114 and the pedestal part of the lower folding guide 111 is increased, so that the total amount (workload) of the pressing force applied to the sheet section and the fold between the additional folding rollers 114 and the pedestal part of the lower folding guide 111 becomes larger than when the additional folding rollers 114 are moved along the fold at the speed V1. When the sheet section is interposed between the additional folding rollers 114 and the fold, the pressing force is dispersed due to the presence of the sheet section to reduce the pressing force applied to the fold. However, when the additional folding rollers 114 are moved along the fold at the pressing position at the speed V2 lower than the speed V1, the total amount (workload) of the pressing force applied to the sheet section and the fold between the additional folding rollers 114 and the pedestal part of the lower folding guide 111 is increased so as to cancel a reduction in the pressing force applied to the fold due to the presence of the sheet section interposed between the additional folding rollers 114 and the fold. Thus, it is possible to prevent the total amount of the pressing force applied to the fold when the sheet section is interposed between the additional folding rollers 114 and fold from being reduced as compared to the total amount of the pressing force applied to the fold when the additional folding rollers 114 directly contact the fold. As a result, it is possible to prevent the effect of the additional folding from varying in accordance with the positional relationship among the additional folding rollers 114, the fold and the sheet section and thus to make the folding height more uniform.

The following describes in detail the operations of the folding device B and the additional folding unit 104 according to the second embodiment with reference to FIGS. 5A to 5D, 6E to 6H, 10, 11A to 11D, and 12E to 12H. In the following description, it is assumed that Z-folding processing is applied to a sheet S by the folding mechanism 103 in the manner as described above, and the Z-folded sheet S is carried in the additional folding unit 104. The sheet S has three sheet sections partitioned by a first fold 132 and a second fold 133 and is Z-folded such that the first fold 132 and the second fold 133 are positioned on the upper side and the lower side of the sheet section, respectively. Further, it is assumed that a thin sheet as a sheet S having a small weight and a thick sheet or a regular sheet as a sheet S having a large weight are carried in the additional folding unit 104.

First, in the folding device B, the folding mechanism 103 applies folding processing to the sheet S to fold the sheet S in a Z-shape such that the first fold 132 and the second fold 133 are positioned on the upper side and the lower side of the sheet section, respectively (step S11). More specifically, when recognizing that the leading end of the sheet S is nipped by the folding roller pair 105, the control part 140 controls, in order to form a folded part in the sheet, the folding mechanism 103 to horizontally move the push plate 107 to a retreat position below the lower conveying guide 109 to thereby form a space for forming a loop between the lower conveying guide 109 and the lower folding guide 111. The loop forming space is thus formed, and then the sheet S is conveyed by a predetermined amount with the leading end thereof nipped by the folding roller pair 105. Then, the intermediate portion of the sheet S is bent downward in the loop forming space to form a loop part in the sheet S. In this state, the push plate 107 is horizontally moved from the retreat position toward the folding roller pair 105 to form a folded part and, after the push plate 107 has almost reached the folding roller pair 105, the folding roller pair 105 is driven to convey the sheet S, whereby the first fold 132 is formed. Subsequently, the push plate 107 is moved to the retreat position, and then the sheet S is conveyed by the folding roller pair 105 to nip the loop part, whereby the second fold 133 is formed, and the thus Z-folded sheet S is conveyed to the downstream of the folding mechanism 103.

Figure 11A:
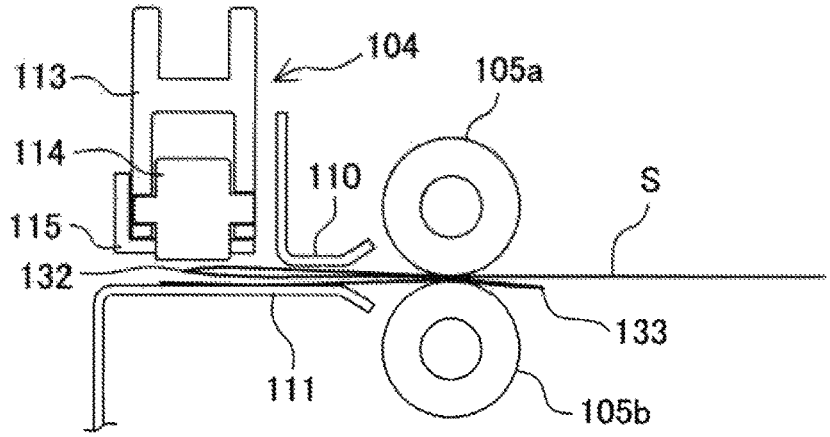

The sheet S thus subjected to the folding processing by the folding mechanism 103 is carried in the additional folding unit 104 through the carry-in port 119 by the folding roller pair 105 (step S12). When the sheet S from the folding mechanism 103 is carried in the additional folding unit 104 through the carry-in port 119 and the carry-in path constituted by the upper carry-in guide 118*a* and lower carry-in guide 118*b*, the additional folding rollers 114 supported by the support member 112 are disposed at the reception position (home position), as illustrated in FIGS. 5A and 11A. At this time, the lower end portions of the respective additional folding rollers 114 supported by the support member 112 regulate the upper side of the carry-in path, and the lower folding guide 111 regulates the lower side of the carry-in path, to thereby guide the first fold 132 of the carried-in sheet S between the additional folding rollers 114 and the lower folding guide 111. Further, at this time, the contact piece 130 is positioned at the end portion of the first bottom horizontal part of the cam groove 131. In the illustrated embodiment, a second retreat position to be described later corresponds to the reception position. However, the reception position may be set to any position different from the second retreat position as long as it is positioned closer to the retreat position (first retreat position or second retreat position) than to the pressing position, and the additional folding rollers 114 and the pedestal part of the lower folding guide 111 are separated from each other.

The control part 140 stops the sheet S when recognizing that the first fold 132 on the leading end side in the carry-in direction of the sheet S carried in the carry-in port 119 from the folding roller pair 105 has reached the additional folding part, i.e., below the additional folding rollers 114 as illustrated in FIG. 11A from the position of the sheet S detected by a sheet position detection means (not illustrated) provided upstream of the folding roller pair 105 (step S13).

Figure 11B:
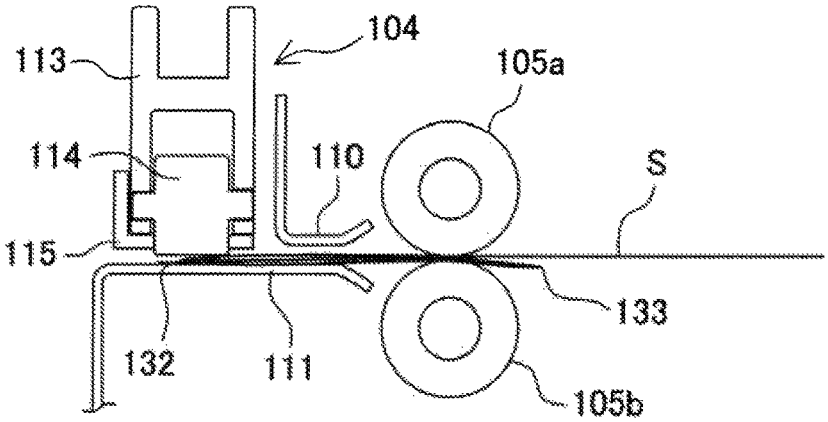

When the first fold 132 is stopped at the additional folding part, the control part 140 drives the additional folding drive motor 128 to horizontally move the support member 112 together with the slider 124 through the pinion integrally rotated with the pulley 126 and the rack 127. As a result, the engaged portion between the contact piece 130 and the cam groove 131 is moved from the first bottom horizontal part to the first slope part and, accordingly, the support member 112 is moved downward toward the pedestal part of the lower folding guide 111. Thus, as illustrated in FIGS. 5B and 11B, the additional folding rollers 114 supported by the support member 112 are moved to the pressing position at which the first fold 132 of the sheet S is sandwiched and pressed between the additional folding rollers 114 and the pedestal part of the lower folding guide 111. At this time, one end portion (end portion on the upstream side in the moving direction of the additional folding rollers 114 in the forward traveling) of the first fold 132 of the sheet S is disposed between the two adjacent additional folding rollers 114 disposed at one outermost end, and the additional folding roller 114 disposed at the other outermost end is placed on the first fold 132 of the sheet S, with the result that the other end portion (end portion on the downstream side in the moving direction of the additional folding rollers 114 in the forward traveling) of the first fold 132 of sheet S is disposed outside the pressing member arrangement area (see FIG. 5B). In the state illustrated in FIG. 5B, one end portion of the first fold 132 of the sheet S is disposed at the intermediate position between the two adjacent additional folding rollers 114 disposed at one outermost end; however, the above phrase "between the two adjacent additional folding rollers 114 disposed at one outermost end" includes a position at which the pressing point of the additional folding roller 114 disposed at one outermost end coincides with one end portion of the first fold 132 of the sheet S. The auxiliary member 113 to which each additional folding roller 114 is attached is biased toward the lower folding guide 111 by the spring 121, so that even after the support member 112 is moved downward to make the additional folding rollers 114 abut against the pedestal part of the lower folding guide 111 through the sheet S, the support member 112 can be moved further downward. Accordingly, the regulating member 115 is also moved further downward to press the first fold 132 of the sheet S positioned below the additional folding rollers 114, thereby regulating the thickness of the first fold 132 of the sheet S to a value not greater than a predetermined thickness. Further, each additional folding roller 114 is biased by the spring 121 to press the first fold 132 of the sheet S toward the pedestal part of the lower folding guide 111. The "carry-in direction" in the present specification refers to a direction in which the sheet S from the folding roller pair 105 is carried in the additional folding unit 104 through the carry-in port 119.

When the additional folding rollers 114 are moved to the pressing position, the control part 140 drives the additional folding drive motor 128 in the state illustrated in FIGS. 5B and 11B to further horizontally move the support member 112 together with the slider 124 to thereby move the engaged portion between the contact piece 130 and the cam groove 131 from the first slope part to the top horizontal part, as illustrated in FIG. 5C. Then, the regulating member 115 attached to the support member 112 regulates the thickness of the first fold 132 of the sheet S to a value not greater than a predetermined thickness (corresponding to the distance d1). At the same time, the additional folding rollers 114 supported by the support member 112 are moved at the pressing position along the first fold 132 relative to the pedestal part of the lower folding guide 111 by a distance equal to or larger than one pitch of the additional folding rollers 114, and the leading additional folding roller 114 in the moving direction thereof is moved to a position beyond the other end portion (end portion on the downstream side in the moving direction of the additional folding rollers 114 in the forward traveling) of the first fold 132 of the sheet S. More specifically, the other end portion of the first fold 132 of the sheet S is disposed between the two adjacent additional folding rollers 114 disposed at the other outermost end, and the additional folding roller 114 disposed at one outermost end is placed on the first fold 132 of the sheet S, with the result that one end portion (end portion on the upstream side in the moving direction of the additional folding rollers 114 in the forward traveling) of the first fold 132 of sheet S is disposed outside the pressing member arrangement area (see FIG. 5C). In the state illustrated in FIG. 5C, the other end portion of the first fold 132 of the sheet S is disposed at the intermediate position between the two adjacent additional folding rollers 114 disposed at the other outermost end; however, the above phrase "between the two adjacent additional folding rollers 114 disposed at the other outermost end" includes a position at which the pressing point of the additional folding roller 114 disposed at the other outermost end coincides with the other end portion of the first fold 132 of the sheet S. In this manner, the first fold 132 is pressed over the entire area thereof by the additional folding rollers 114 and the pedestal part of the lower folding guide 111, whereby strengthening (additional folding) of the first fold 132 is achieved.

When moving the additional folding rollers 114 along the fold at the pressing position as described above, the control part 140 controls the operation of the second moving mechanism 117 to change the speed at which the additional folding rollers 114 are moved along the fold according to whether the additional folding rollers 114 can directly contact the fold, i.e., whether the sheet section is interposed between the additional folding rollers 114 and the fold (step S14).

When the fold is positioned on the upper side of the sheet section as in the case of the first fold 132 of the sheet S on the leading end side in the conveying direction of the sheet S to allow the additional folding rollers 114 to directly contact the fold, the control part 140 controls the operation of the second moving mechanism 117 to move the additional folding rollers 114 relative to the pedestal part of the lower folding guide 111 along the first fold 132 at the pressing position at the predetermined speed V1 to apply the additional folding processing to the first fold 132 (step S15).

Figure 11C:
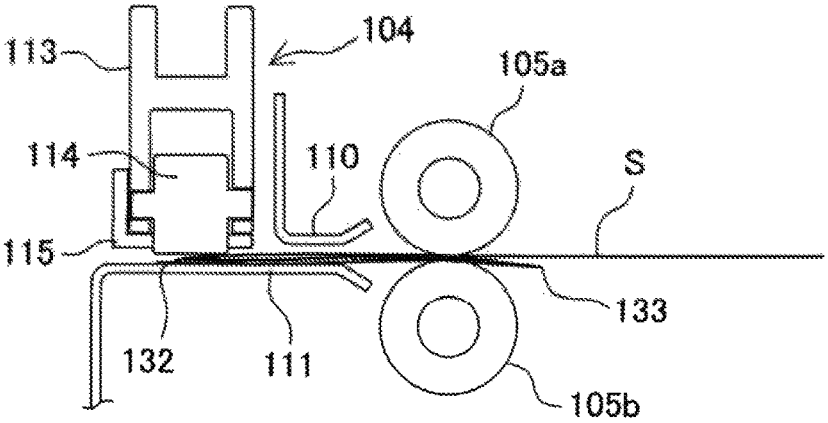
Figure 11D:
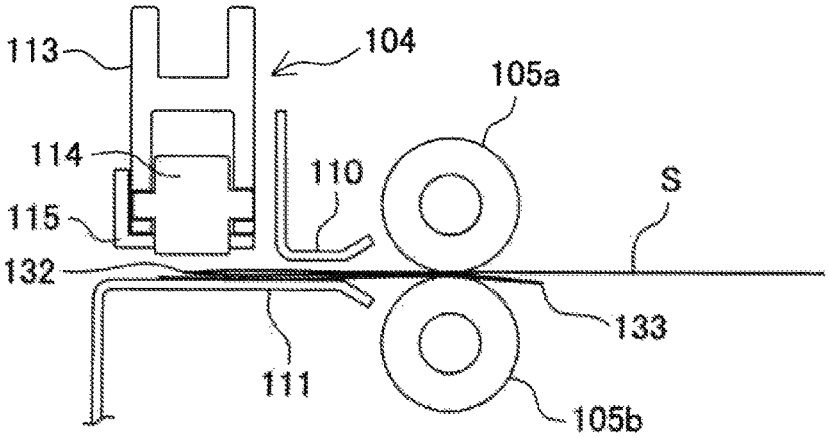

After completion of pressing against the first fold 132, the control part 140 drives the additional folding drive motor 128 in the state illustrated in FIGS. 5C and 11C to further horizontally move the support member 112 together with the slider 124 to thereby move the engaged portion between the contact piece 130 and the cam groove 131 from the top horizontal part to the second bottom horizontal part through the second slope part. Thus, as illustrated in FIGS. 5D and 11D, the support member 112 is moved upward together with the regulating member 115 in a direction separating from the pedestal part of the lower folding guide 111 to reach the first retreat position above and near a position at which the plurality of additional folding rollers 114 supported by the support member 112 end their pressing operation, whereby the first additional folding processing is completed. The first retreat position differs from the reception position (home position). When the operation state comes to the state illustrated in FIGS. 5D and 11D after completion of the first additional folding processing, it becomes possible for the sheet S to be conveyed from the additional folding part, and the sheet S is conveyed downstream by the conveying roller pair 102 and folding roller pair 105 which are positioned on the upstream side in the carry-in direction (step S16).

The sheet S whose first fold 132 has been subjected to the additional folding processing is thus conveyed and, as in the case of the additional folding processing for the first fold 132, the control part 140 stops the sheet S as illustrated in FIG. 12D when recognizing that the second fold 133 has reached the additional folding part from the position of the sheet S detected by a sheet position detection means (not illustrated) provided upstream of the folding roller pair 105 (step S13).

Figure 12E:
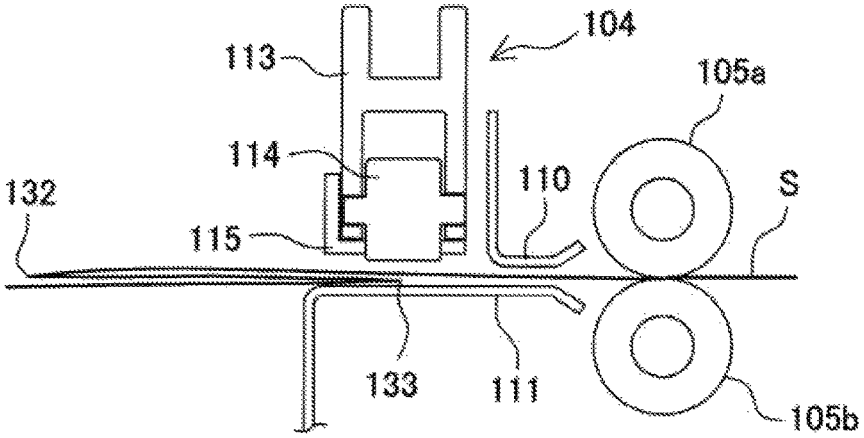
Figure 12F:
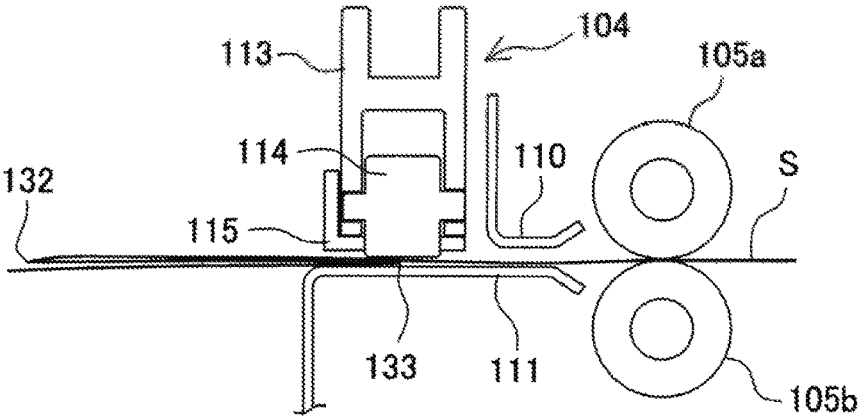

When the second fold 133 is stopped at the additional folding part, the control part 140 drives the additional folding drive motor 128 to rotate in the rotation direction opposite to the rotation direction in the forward traveling, to thereby horizontally move the support member 112 together with the slider 124 through the pinion integrally rotated with the pulley 126 and the rack 127 in the direction opposite to the moving direction in the forward traveling. As a result, the engaged portion between the contact piece 130 and the cam groove 131 is moved from the second bottom horizontal part to the second slope part and, accordingly, the support member 112 is moved downward toward the pedestal part of the lower folding guide 111. Thus, as illustrated in FIGS. 6F and 12F, the additional folding rollers 114 supported by the support member 112 are moved to the pressing position at which the second fold 133 of the sheet S is sandwiched and pressed between the additional folding rollers 114 and the pedestal part of the lower folding guide 111. The position of each of the plurality of additional folding rollers 114 at this state, i.e., the position of the start point of the backward traveling coincides with the position of the end point of the forward traveling. At this time, one end portion (end portion on the upstream side in the moving direction of the additional folding rollers 114 in the backward traveling) of the second fold 133 of the sheet S is disposed between the two adjacent additional folding rollers 114 disposed at one outermost end, and the additional folding roller 114 disposed at the other outermost end is placed on the second fold 133 of the sheet S, with the result that the other end portion (end portion on the downstream side in the moving direction of the additional folding rollers 114 in the backward traveling) of the second fold 133 of the sheet S is disposed outside the pressing member arrangement area (see FIG. 6F). The auxiliary member 113 to which each additional folding roller 114 is attached is biased toward the pedestal part of the lower folding guide 111 by the spring 121, so that even after the support member 112 is moved downward to make the additional folding rollers 114 abut against the pedestal part of the lower folding guide 111 through the sheet S, the support member 112 can be moved further downward. Accordingly, the regulating member 115 is also moved further downward to press the sheet section and second fold 133 of the sheet S positioned below the additional folding rollers 114, thereby regulating the thickness of the sheet section and the second fold 133 of the sheet S to a value not greater than a predetermined thickness. Further, each additional folding roller 114 is biased by the spring 121 to press the sheet section and the second fold 133 of the sheet S toward the pedestal part of the lower folding guide 111.

When the additional folding rollers 114 are moved to the pressing position, the control part 140 drives the additional folding drive motor 128 in the state illustrated in FIGS. 6F and 12F to further horizontally move the support member 112 together with the slider 124 in the direction opposite to the moving direction in the forward traveling to thereby move the engaged portion between the contact piece 130 and the cam groove 131 from the second slope part to the top horizontal part, as illustrated in FIG. 6G. Then, the regulating member 115 attached to the support member 112 regulates the thickness of the sheet section and the second fold 133 of the sheet S positioned below the additional folding rollers 114 to a value not greater than a predetermined thickness (corresponding to the distance d1). At the same time, the additional folding rollers 114 supported by the support member 112 are moved at the pressing position along the second fold 133 of the sheet S relative to the pedestal part of the lower folding guide 111 in the direction opposite to the moving direction in the forward traveling by a distance equal to or larger than one pitch of the additional folding rollers 114, and the leading additional folding roller 114 in the moving direction thereof is moved to a position beyond the other end portion (end portion on the downstream side in the moving direction of the additional folding rollers 114 in the backward traveling) of the second fold 133 of the sheet S. In this manner, the second fold 133 is pressed over the entire area thereof by the additional folding rollers 114 and the pedestal part of the lower folding guide 111, whereby strengthening (additional folding) of the second fold 133 is achieved.

As in the case of the additional folding processing for the first fold 132, when moving the additional folding rollers 114 along the fold 133 at the pressing position, the control part 140 controls the operation of the second moving mechanism 117 to change the speed at which the additional folding rollers 114 are moved along the fold according to whether the additional folding rollers 114 can directly contact the fold, i.e., whether the sheet section is interposed between the additional folding rollers 114 and the fold (step S14).

When the fold is positioned on the lower side of the sheet section as in the case of the second fold 133 of the sheet S on the rear end side in the conveying direction of the sheet S to make the sheet section be interposed between the additional folding rollers 114 and the fold, the control part 140 controls the operation of the second moving mechanism 117 to move the additional folding rollers 114 relative to the pedestal part of the lower folding guide 111 along the second fold 133 at the pressing position at the speed V2 lower than the speed V1 to apply additional folding to the second fold 133 (step S17).

When the sheet section is interposed between the additional folding rollers 114 and the fold, the pressing force is dispersed due to the presence of the sheet section to reduce the pressing force applied to the fold. However, when the additional folding rollers 114 disposed at the pressing position are moved at the speed V2 lower than the speed V1, the period of time during which the sheet section and the second fold 133 are pressed by the plurality of additional folding rollers 114 and the pedestal part of the lower folding guide 111 is elongated to increase the total amount (workload) of the pressing force applied to the sheet section and the second fold 133 by the plurality of additional folding rollers 114 and the pedestal part of the lower folding guide 111. Thus, a reduction in the pressing force applied to the fold due to the presence of the sheet section interposed between the additional folding rollers 114 and the fold is canceled by an increase in the total amount of the pressing force applied to the sheet section and the second fold 133 due to a reduction in the moving speed of the additional folding rollers 114 along the second fold 133. As a result, it is possible to prevent the total amount of the pressing force applied to the second fold 133 when the sheet section is interposed between the additional folding rollers 114 and the second fold 133 from being reduced as compared to the total amount of the pressing force applied when the additional folding rollers 114 directly contact the first fold 132. This makes it possible to prevent the effect of the additional folding from varying in accordance with the positional relationship among the additional folding rollers 114, the second fold 133 and the sheet section and thus to make the folding height more uniform.

Further, in steps S15 and S17, when the sheet section is interposed between the additional folding rollers 114 and the fold, the control part 140 may control the operation of the second moving mechanism 117 so as to make the speed at which the additional folding rollers 114 are moved along the second fold 133 at the pressing position lower when the weight of the sheet S acquired by the sheet weight detection sensor 141 is equal to or larger than a predetermined threshold value a than when the weight of the sheet S acquired by the sheet weight detection sensor 141 is smaller than the predetermined threshold value $\alpha$. This increases the period of time during which the sheet section and the second fold 133 are pressed between the additional folding rollers 114 and the pedestal part of the lower folding guide 111 to increase the total amount (workload) of the pressing force applied to the second fold 133. As a result, the effect of strengthening the fold is increased when the sheet S is a sheet having a weight equal to or larger than a predetermined threshold value and thus difficult to fold, like a thick sheet. Thus, it is possible to make the folding height more uniform irrespective of the weight of the sheet. When the weight of the sheet S acquired by the sheet weight detection sensor 141 is equal to or larger than a predetermined threshold value $\alpha$, the control part 140 may control the operation of the second moving mechanism 117 so as to reduce the speed at which the additional folding rollers 114 are moved along the fold at the pressing position as compared to when the weight of the sheet S acquired by the sheet weight detection sensor 141 is smaller than the predetermined threshold value $\alpha$ not only when the sheet section is interposed between the additional folding rollers 114 and the fold, but also when the additional folding rollers 114 directly contact the fold.

Further, in addition to the control of the moving speed along the fold, the control part 140 may control the second moving mechanism 117 so as to make the number of times the additional folding rollers 114 disposed at the pressing position are moved along the fold larger when the pressing force is applied to the fold between the additional folding rollers 114 and the pedestal part of the lower folding guide 111 with the sheet section interposed between the additional folding rollers 114 and the fold as in the case of the additional folding processing for the second fold 133 in step S17 than when the pressing force is applied with the additional folding rollers 114 directly contacting the fold as in the case of the additional folding processing for the first fold 132 in step S15. The number of times of the movement for one fold indicates that the entire fold is subjected to the additional folding processing by the movement of the support member 112 along the fold of the sheet S. Specifically, a one-way stroke of the engaged portion between the contact piece 130 and the cam groove 131 from one end to the other end or from the other end to the one end of the top horizontal part of the cam groove 131 corresponds to the number of times of the movement for one fold. This increases the period of time during which the second fold 133 is pressed between the additional folding rollers 114 and the pedestal part of the lower folding guide 111 to increase the total amount of the pressing force applied to the second fold 133. Thus, a reduction in the pressing force applied to the fold due to the presence of the sheet section interposed between the additional folding rollers 114 and the fold is canceled also by an increase in the total amount of the pressing force applied to the sheet section and the second fold 133 due to an increase in the number of times of the movement of the additional folding rollers 114 along the second fold 133. As a result, it is possible to further prevent the total amount of the pressing force applied to the second fold 133 when the sheet section is interposed between the additional folding rollers 114 and the second fold 133 from being reduced as compared to the total amount of the pressing force applied when the additional folding rollers 114 directly contact the first fold 132. This makes it possible to further prevent the effect of the additional folding from varying in accordance with the positional relationship among the additional folding rollers 114, the second fold 133 and the sheet section and thus to make the folding height more uniform irrespective of the positional relationship among the additional folding roller, the fold and the sheet section.

Further, in addition to the control of the moving speed along the fold, the control part 140 may control the first moving mechanism 116 so as to make stronger the pressing force applied to the sheet section and the fold between the additional folding rollers 114 and the pedestal part of the lower folding guide 111 when the pressing force is applied with the sheet section interposed between the additional folding rollers 114 and the fold as in the case of the additional folding processing for the second fold 133 than when the additional folding rollers 114 directly face and contact the fold. This further increases the total amount of the pressing force applied to the fold between the additional folding rollers 114 and the pedestal part of the lower folding guide 111. As a result, it is possible to further prevent the total amount of the pressing force applied to the second fold 133 when the sheet section is interposed between the additional folding rollers 114 and the second fold 133 from being reduced as compared to the total amount of the pressing force applied when the additional folding rollers 114 directly contact the first fold 132. This makes it possible to further prevent the effect of the additional folding from varying in accordance with the positional relationship among the additional folding rollers 114, the second fold 133 and the sheet section and thus to make the folding height more uniform irrespective of the positional relationship among the additional folding roller, the fold and the sheet section.

Figure 12G:
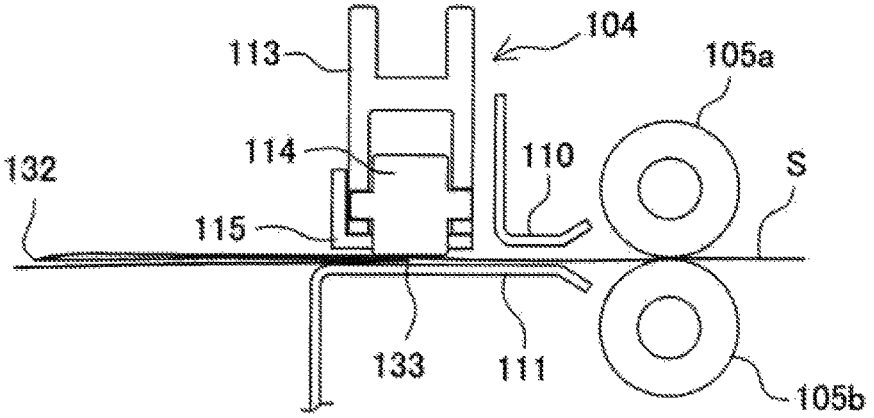
Figure 12H:
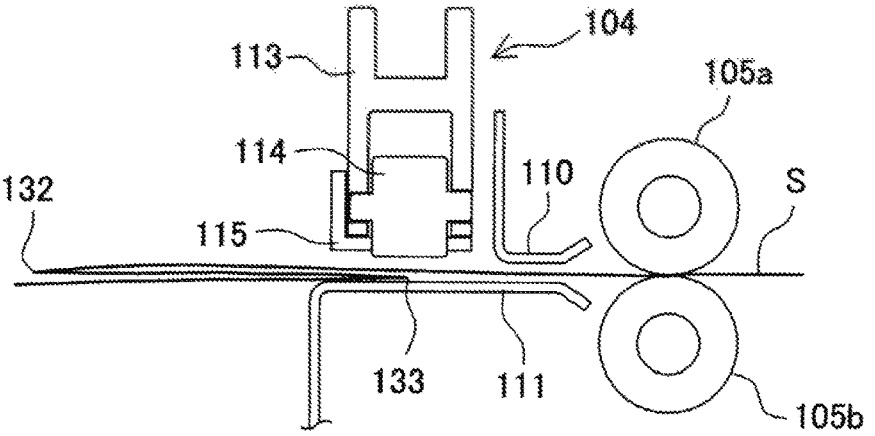

After completion of the additional folding processing for the second fold 133, the control part 140 drives the additional folding drive motor 128 in the state illustrated in FIGS. 6G and 12G to further horizontally move the support member 112 together with the slider 124 in the direction opposite to the moving direction in the forward traveling to thereby move the engaged portion between the contact piece 130 and the cam groove 131 from the top horizontal part to the first bottom horizontal part through the first slope part. As a result, as illustrated in FIGS. 6H and 12H, the support member 112 is moved upward together with the regulating member 115 in a direction separating from the pedestal part of the lower folding guide 111 to reach the second retreat position near a position at which the additional folding rollers 114 supported by the support member 112 end their pressing operation, whereby second additional folding processing is completed. In the present embodiment, the second retreat position is set at the same position as the reception position (home position). However, the second retreat position may be set at a position different from the reception position. When the operation state comes to the state illustrated in FIGS. 6H and 12H after completion of the second additional folding processing, it becomes possible for the sheet S to be conveyed from the additional folding part, and the sheet S is conveyed downstream by the conveying roller pair 102 and the folding roller pair 105 which are positioned on the upstream side in the carry-in direction (step S16).

When two or more folds are formed in one sheet like a Z-folded sheet, a three-folded sheet or the like, the operations from step S13 to step S17 are repeated until additional folding processing for the last fold is completed (step S18). That is, every time the fold of the sheet S is disposed at the additional folding part, the conveyance of the sheet S is stopped, and the additional folding rollers 114 are moved along the fold of the sheet S to perform additional folding processing. After completion of the additional folding processing for all folds, the sheet S that has been subjected to the additional folding processing is conveyed to the post-processing device C. The lower end portions of the additional folding rollers 114 and the bottom surface of the regulating member 115 at the retreat position function also as a guide for discharging the sheet S that has been subjected to the additional folding.

In the additional folding unit 104, when the additional folding rollers 114 are moved relative to the pedestal part of the lower folding guide 111 by the first moving mechanism 116 from the retreat position or the reception position to the pressing position, one end portion (end portion on the upstream side in the moving direction along the fold) of the fold of the sheet S is disposed between the two adjacent additional folding rollers 114 positioned at one outermost end of the pressing member arrangement area, and the other end portion (end portion on the downstream side in the moving direction along the fold) of the fold is disposed outside (i.e., outside of the additional folding roller 114 positioned at the other outermost position of the pressing member arrangement area) of the pressing member arrangement area. When the additional folding rollers 114 are arranged so as to be separated from one another at equal intervals in the moving direction thereof along the fold, it is necessary to move the additional folding rollers 114 along the fold by a distance equal to or larger than the interval (i.e., distance corresponding to one pitch) between the two adjacent additional folding rollers 114 in order to press completely the fold positioned between the two adjacent additional folding rollers 114 by the additional folding rollers 114 and the pedestal part of the lower folding guide 111. Thus, when the additional folding rollers 114, i.e., support member 112 is moved along the fold by a distance equal to or larger than one pitch of the additional folding rollers 114, which is the minimum distance required for achieving additional folding processing, the additional folding roller 114 at the outermost end on the upstream side in the moving direction along the fold goes beyond the end portion of the sheet S on the upstream side in the moving direction and is reliably moved to the position of the additional folding roller 114 adjacent to the upstream side in the moving direction thereof at the starting period of the movement, with the result that the end portion of the sheet S positioned, at the starting period, between the two adjacent additional folding rollers 114 at one outermost end on the upstream side in the moving direction is pressed (additionally folded).

Further, with the movement of the additional folding rollers 114 along the fold, the additional folding unit 104 performs additional folding of a first fold in the forward traveling and performs additional folding of a second fold in the backward traveling when a plurality of folds are formed in one sheet S (as in a Z-folded sheet or an inwardly three-folded sheet). Thus, it is possible to apply additional folding processing to a plurality of folds by pressing different folds in the forward traveling and backward traveling. That is, it is possible to apply additional folding processing to a plurality of folds efficiently in short times while suppressing an increase in time required for the additional folding processing.

In the above description, the additional folding unit 104 applies additional folding processing to the Z-folded sheet;

however, the additional folding unit 104 can accommodate itself to a two-folded sheet, a four-folded sheet and the like. In a case where only one fold is formed in one sheet like a two-folded sheet, additional folding processing is first applied to the fold of a preceding sheet in the forward traveling, and after discharge of the preceding sheet, additional folding processing is applied to the fold of the succeeding sheet in the backward traveling, whereby additional folding processing can be efficiently applied to successively conveyed sheets in short times. Further, in a case where three or more folds are formed in one sheet like a four-folded sheet, the conveyance of the sheet is stopped every time the fold reaches below the additional folding rollers 114, and the additional folding rollers 114 are moved along the fold in the forward traveling or backward traveling to perform additional folding processing. In addition, the target of the folding processing may be a sheet bundle or a single sheet. The sheet bundle may be a bound sheet bundle or a sheet bundle that is not bound.

Third Embodiment

Figure 13:
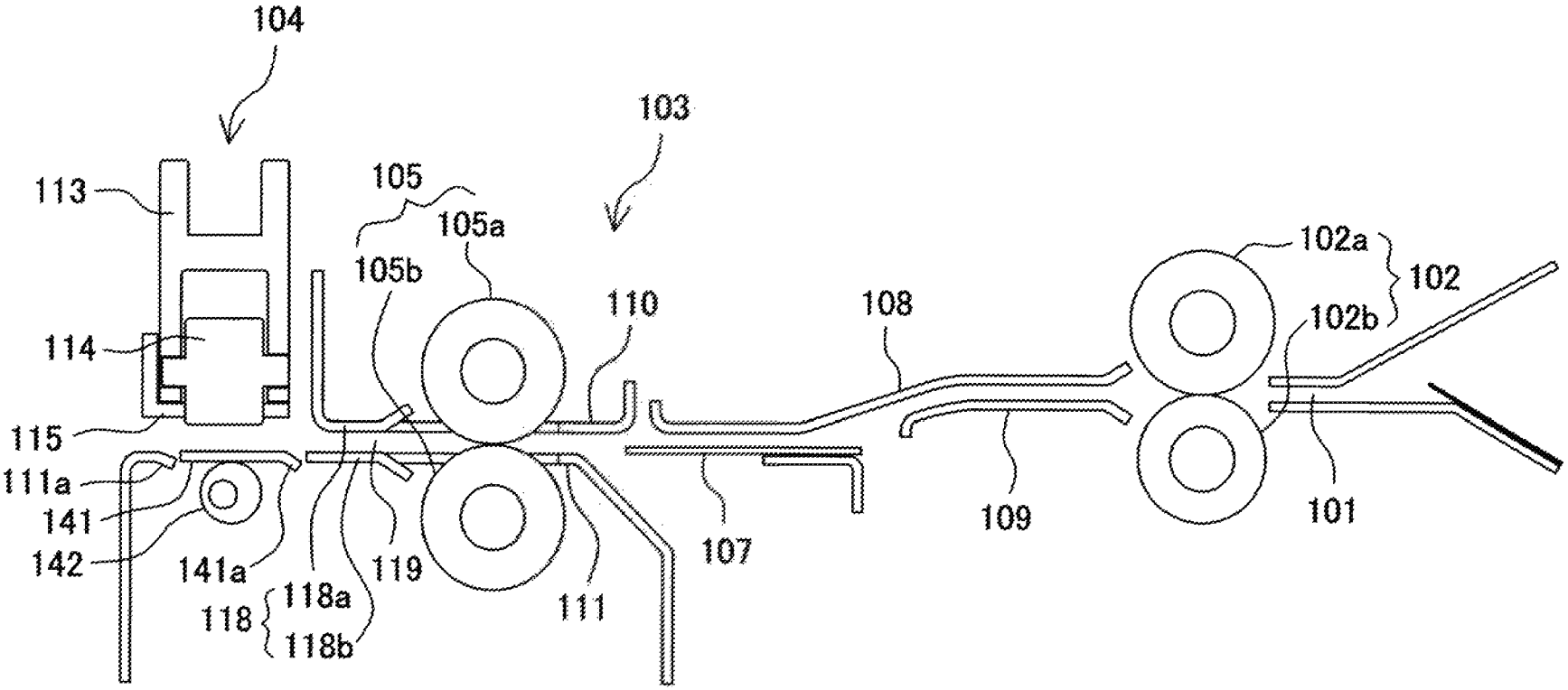
FIG. 13 is an explanatory view illustrating the main part according to a third embodiment of the folding mechanism and the additional folding unit (corresponding to the sheet pressing device) of the folding device illustrated in FIG. 1.
Figure 14:
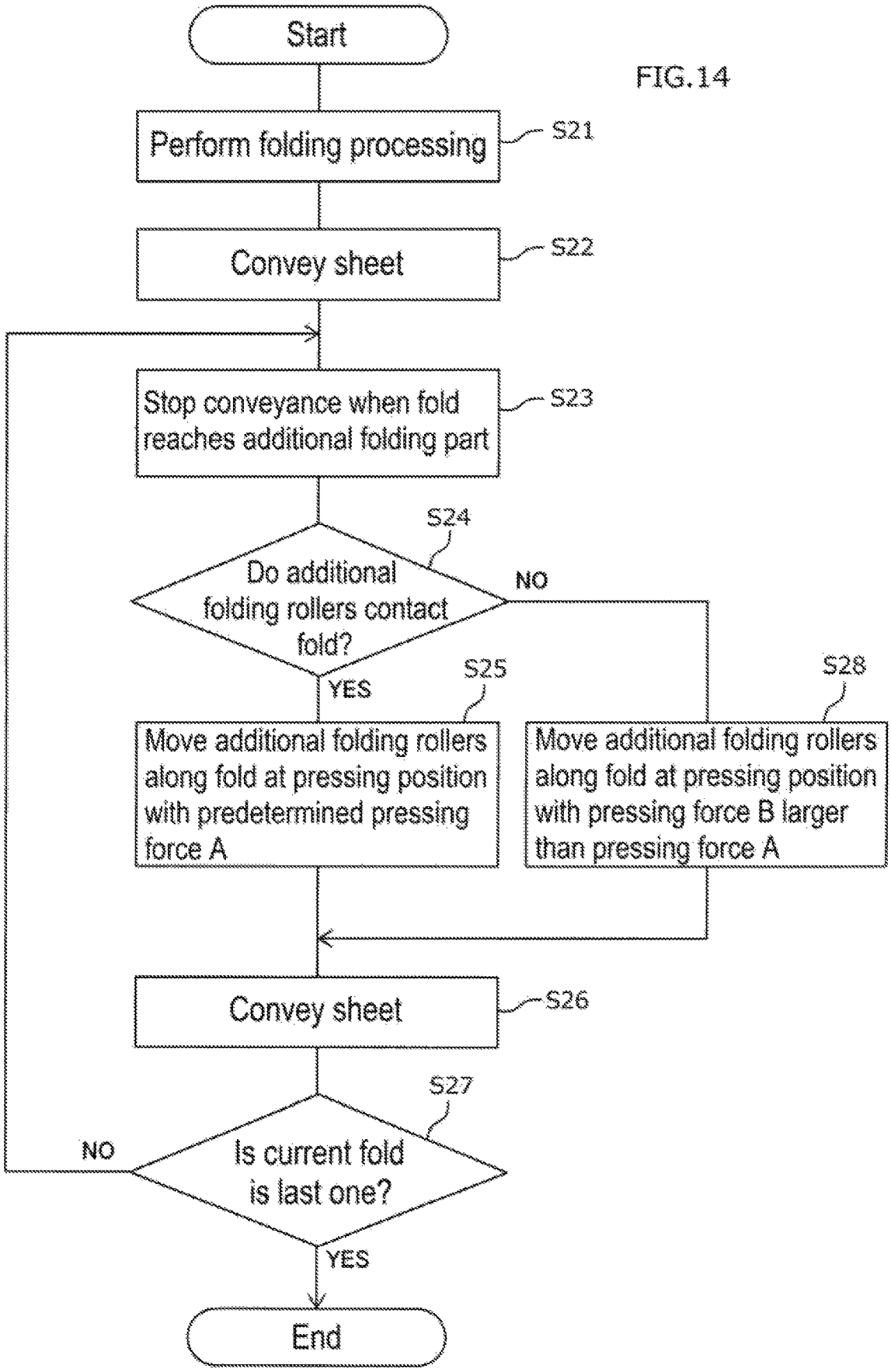
FIG. 14 is a flowchart illustrating the operation according to a third embodiment of the folding device illustrated in FIG. 1.

In a third embodiment illustrated in FIG. 13, the first moving mechanism 116 includes a pressure adjusting cam 142 as a distance adjusting mechanism for changing the distance between the support member 112 and a pressing pedestal 141 at the pressing position. The pressure adjusting cam 142 is disposed below the pressing pedestal 141 so as to contact the pressing pedestal 141. The pressure adjusting cam 142 is rotated about its eccentric rotation axis by a not-shown cam drive motor to move upward the pressing pedestal 141 toward the additional folding rollers 114 through a window part of the lower folding guide 111. The upstream end portion of the pressing pedestal 141 and the side edge portion of the lower folding guide 111 adjacent to the downstream side of the window part have a slope 141*a* and a slope 111*a*, respectively, which are inclined downward in order to smoothly pass the leading end of the sheet S from the lower folding guide 111 positioned upstream of the pressing pedestal 141 to the pressing pedestal 141 and from the pressing pedestal 141 to the lower folding guide 111 positioned downstream thereof.

The control part 140 controls the operation of the pressure adjusting cam 142 as the distance adjusting mechanism of the first moving mechanism 116 as follows: when the sheet section (a part of the sheet S partitioned by the folds) is not interposed between the additional folding rollers 114 and the fold to allow the additional folding rollers 114 to directly contact the fold, the pressing pedestal 141 is moved to a regular position at which the upper surface of the pressing pedestal 141 is aligned with the upper surface of the lower folding guide 111, while when the sheet section is interposed between the additional folding rollers 114 and the fold, the pressing pedestal 141 is moved to a proximity position higher in height than the above regular position (specifically, the pressing pedestal 141 is moved upward from the regular position toward the additional folding rollers 114 so as to reduce the distance between the support member 112 and the pressing pedestal 141 at the pressing position). Thus, at the proximity position, the distance between the support member 112 supporting the additional folding rollers 114 and the pressing pedestal 141 at the pressing position is reduced, so that the compression amount of the spring 121 when the additional folding rollers 114 contact the sheet S at the pressing position becomes larger than the compression amount of the spring 121 when the additional folding rollers 114 contact the sheet S at the regular position, increasing the pressing force applied to the sheet S between the additional folding rollers 114 and the pressing pedestal 141. As a result, it is possible to cancel a reduction in the pressing force applied to the fold due to the presence of the sheet section interposed between the additional folding rollers 114 and fold to make it possible to prevent the pressing force applied to the fold when the sheet section is interposed between the additional folding rollers 114 and the fold from being reduced as compared to the pressing force applied to the fold when the additional folding rollers 114 directly contact the fold. Thus, it is possible to prevent the effect of the additional folding from varying in accordance with the positional relationship among the additional folding rollers 114, the fold and the sheet section and thus to make the folding height more uniform.

The following describes the control of the distance adjusting mechanism performed by the control part 140 of the folding device B in the additional folding illustrated in FIGS. 5A to 5D and 6E to 6H with reference to FIGS. 14, 15A to 15C and 16D to 16F. In the following description, it is assumed that a Z-folded sheet in which the first fold 132 and the second fold 133 are positioned on the upper side and the lower side of the sheet section, respectively, is carried in the additional folding unit 104, as illustrated in 15A to 15C and 16D to 16F.

First, in the folding device B, the folding mechanism 103 applies folding processing to the sheet S to fold the sheet S in a Z-shape such that the first fold 132 and the second fold 133 are positioned on the upper side and the lower side of the sheet section, respectively (step S21). More specifically, when recognizing that the leading end of the sheet S is nipped by the folding roller pair 105, the control part 140 controls, in order to form a folded part in the sheet, the folding mechanism 103 to horizontally move the push plate 107 to the retreat position below the lower conveying guide 109 to thereby form a space for forming a loop between the lower conveying guide 109 and the lower folding guide 111. The loop forming space is thus formed, and then the sheet S is conveyed by a predetermined amount with the leading end thereof nipped by the folding roller pair 105. Then, the intermediate portion of the sheet S is bent downward in the loop forming a space to form a loop part in the sheet S. In this state, the push plate 107 is horizontally moved from the retreat position toward the folding roller pair 105 to form a folded part and, after the push plate 107 has almost reached the folding roller pair 105, the folding roller pair 105 is driven to convey the sheet S, whereby the first fold 132 is formed. Subsequently, the push plate 107 is moved to the retreat position, and then the sheet S is conveyed by the folding roller pair 105 to nip the loop part, whereby the second fold 133 is formed, and the thus Z-folded sheet S is conveyed downstream.

Figure 15A:
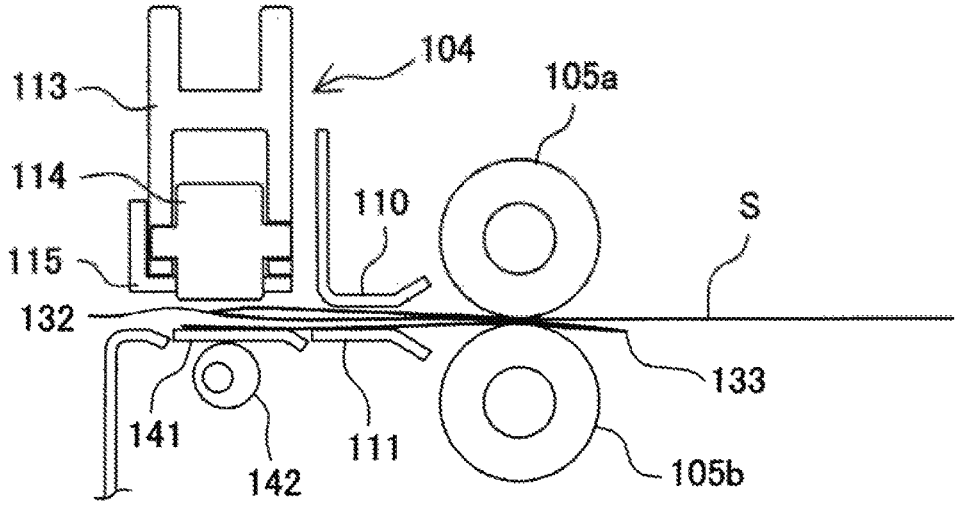

The sheet S thus subjected to the folding processing by the folding mechanism 103 is carried in the additional folding unit 104 through the carry-in port 119 by the folding roller pair 105 (step S12). The additional folding unit 104 receives therein the sheet S in a state where the additional folding rollers 114 are located at the retreat position or at the reception position separated toward the retreat position side from the pressing pedestal 141 further away than the pressing position is. At this time, the control part 140 stops the sheet S when recognizing that the first fold 132 of the sheet S has reached the additional folding part, i.e., below the additional folding rollers 114 as illustrated in FIG. 15A from the position of the sheet S detected by a sheet position detection means (not illustrated) provided upstream of the folding roller pair 105 (step S23).

When the first fold 132 is stopped at the additional folding part, the control part 140 controls the operation of the distance adjusting mechanism included in the first moving mechanism 116 to change the distance between the support member 112 supporting the additional folding rollers 114 and the pressing pedestal 141 at the pressing position according to whether the additional folding rollers 114 can directly contact the fold, i.e., whether the sheet section is interposed between the additional folding rollers 114 and the fold (step S24). When the fold is positioned on the upper side of the sheet section as in the case of the first fold 132 of the sheet S on the leading end side in the conveying direction of the sheet S to allow the additional folding rollers 114 to directly contact the fold, the control part 140 controls the operations of the first moving mechanism 116 and distance adjusting mechanism to move the support member 112 supporting the additional folding rollers 114 relative to the pressing pedestal 141 such that the distance between the support member 112 and pressing pedestal 141 at the pressing position becomes a first distance X1 and moves the additional folding rollers 114 relative to the pressing pedestal 141 along the fold at the pressing position by the second moving mechanism 117 (step S25).

Figure 15B:
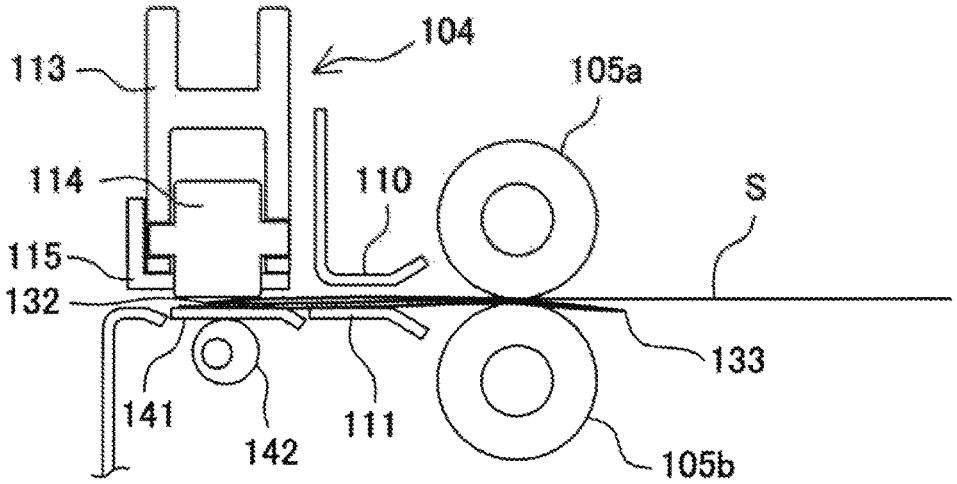

In the illustrated embodiment, as illustrated in FIG. 15B, the control part 140 drives a not-shown cam drive motor to rotate the pressure adjusting cam 142 contacting the pressing pedestal 141 so as to align the upper surface of the pressing pedestal 141 with the upper surface of the lower folding guide 111 and controls the first moving mechanism 116 to move downward (toward the pressing pedestal 141) the support member 112, by a predetermined distance, up to the height position of the pressing position. Thereafter, the additional folding rollers 114 supported by the support member 112 are moved by the second moving mechanism 117 relative to the pressing pedestal 141 along the first fold 132 to press the first fold 132 with a first pressing force, whereby additional folding processing is applied to the first fold 132.

Figure 15C:
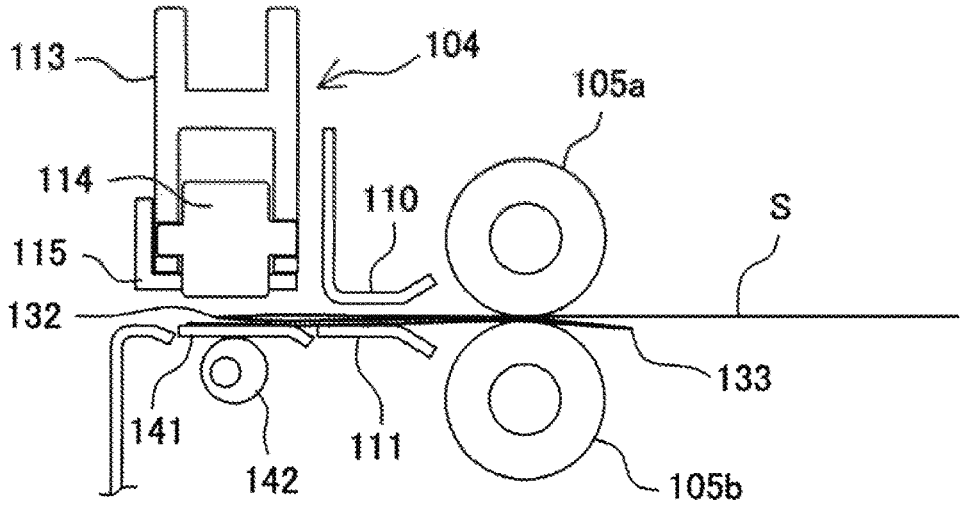

As illustrated in FIG. 15C, after completion of the additional folding processing for the first fold 132, the control part 140 controls the first moving mechanism 116 to move upward the additional folding rollers 114 supported by the support member 112 toward the retreat position in a direction separating from the pressing pedestal 141 by a predetermined distance and conveys the sheet S downstream (step S26).

Figure 16D:
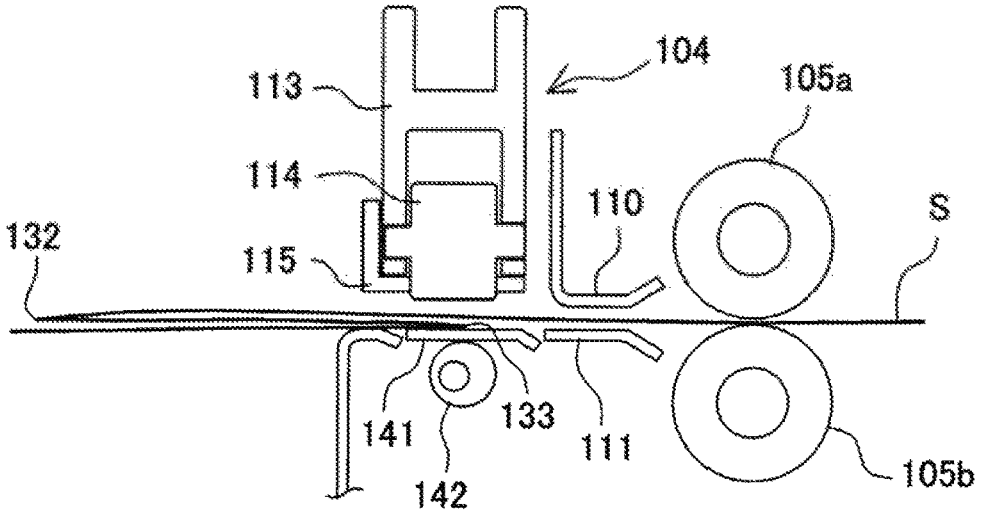

The sheet S whose first fold 132 has been subjected to the additional folding processing is thus conveyed and, as in the case of the additional folding processing for the first fold 132, the control part 140 stops the sheet S when recognizing that the second fold 133 has reached the additional folding part, i.e., below the additional folding rollers 114 as illustrated in FIG. 16D according to the position of the sheet S detected by a sheet position detection means (not illustrated) provided upstream of the folding roller pair 105 (step S23).

Figure 16E:
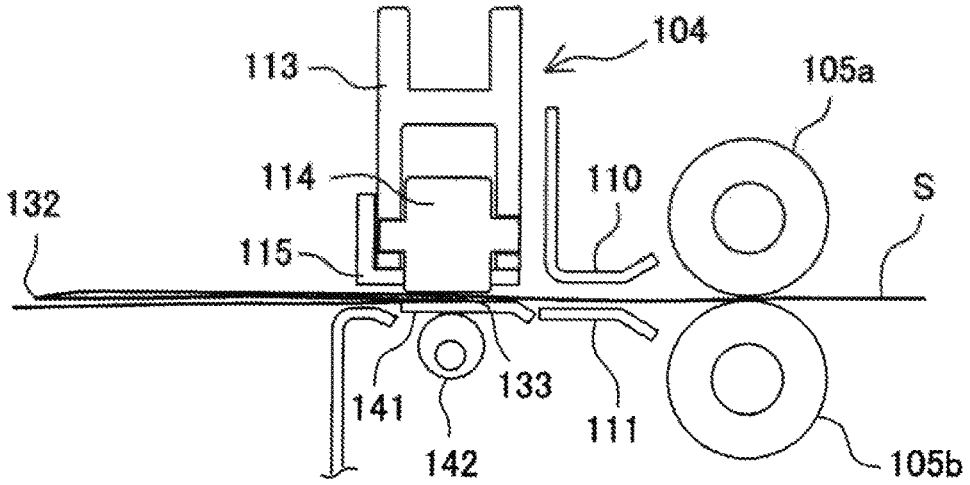

As in the case of the additional folding processing for the first fold 132, when the second fold 133 is stopped at the additional folding part, the control part 140 controls the operation of the distance adjusting mechanism included in the first moving mechanism 116 to change the distance between the support member 112 supporting the additional folding rollers 114 and pressing pedestal 141 at the pressing position according to whether the sheet section is interposed between the additional folding rollers 114 and the fold (step S24). When the fold is positioned on the lower side of the sheet section as in the case of the second fold 133 of the sheet S on the rear end side in the conveying direction of the sheet S to make the sheet section be interposed between the additional folding rollers 114 and the fold, the control part 140 controls the operations of the first moving mechanism 116 and distance adjusting mechanism to move the support member 112 supporting the additional folding rollers 114 relative to the pressing pedestal 141 such that the distance between the support member 112 and the pressing pedestal 141 at the pressing position becomes a second distance X2 smaller than the first distance X1 and moves the additional folding rollers 114 relative to the pressing pedestal 141 along the fold at the pressing position by the second moving mechanism 117 (step S28). In the illustrated embodiment, as illustrated in FIG. 16E, the control part 140 drives a not-shown cam drive motor to rotate the pressure adjusting cam 142 contacting the pressing pedestal 141 so as to dispose the upper surface of the pressing pedestal 141 at a position higher than the upper surface of the lower folding guide 111 and controls the first moving mechanism 116 to move downward (toward the pressing pedestal 141) the support member 112, by a predetermined distance, up to the height position of the pressing position. Thereafter, the additional folding rollers 114 supported by the support member 112 are moved by the second moving mechanism 117 relative to the pressing pedestal 141 along the second fold 133 to press the second fold 133 with a second pressing force, whereby additional folding processing is applied to the second fold 133.

At this time, at the pressing position, the support member 112 is disposed at a position separated from the pressing pedestal 141 by the second distance X2 smaller than the first distance X1, so that the compression amount of the spring 121 interposed between the auxiliary member 113 to which each of the additional folding rollers 114 is attached and the support member 112 supporting the auxiliary member 113 is increased as compared to that when the first fold 132 is pressed, with the result that the second pressing force applied to the second fold 133 becomes larger than the first pressing force applied to the first fold 132. When the sheet section is interposed between the additional folding rollers 114 and the fold, the pressing force is dispersed to reduce the pressing force applied to the fold; however, the second pressing force is larger than the first pressing force, so that it is possible to cancel a reduction in the pressing force applied to the fold to make it possible to prevent the pressing force applied to the fold when the sheet section is interposed between the additional folding rollers 114 and the fold from being reduced as compared to the pressing force applied to the fold when the additional folding rollers 114 directly contact the fold. Thus, it is possible to prevent the effect of the additional folding from varying in accordance with the positional relationship among the additional folding rollers 114, the fold and the sheet section and thus to make the folding height more uniform.

Further, in a case like the additional folding processing for the second fold 133 in step S28, where the pressing force is applied to the fold between the additional folding rollers 114 and the pressing pedestal 141 with the sheet section interposed between the additional folding rollers 114 and the fold (that is, the additional folding rollers 114 are moved along the fold in a state where the support member 112 supporting the additional folding rollers 114 is moved relative to pressing pedestal 141 such that the distance between the support member 112 and the pressing pedestal 141 becomes the distance X2 smaller than the first distance X1 at the pressing position), the control part 140 preferably controls the second moving mechanism 117 so as to move the additional folding rollers 114 along the fold at a speed lower than that when the pressing is performed with the additional folding rollers 114 directly contacting the fold as in the case of the additional folding processing for the first fold 132 in step S24. This increases the workload of the pressing force applied to the fold between the additional folding rollers 114 and the pressing pedestal 141, making it possible to enhance the effect of strengthening the fold. Thus, it is possible to further prevent the effect of the additional folding from varying in accordance with the positional relationship among the additional folding roller, the fold and the sheet section and thus to make the folding height more uniform.

Further, the control part 140 may acquire, from the sheet weight recognizing means, information concerning the weight of the sheet S to be subjected to the additional folding processing and control the operation of the distance adjusting mechanism according to the acquired weight of the sheet S to change the second distance X2 between the support member 112 and the pressing pedestal 141 in step S28. For example, when the weight of the sheet S acquired by the sheet weight recognizing means is smaller than a predetermined value, the control part 140 may control, in step S28, the rotation position of the pressure adjusting cam 142 as the distance adjusting mechanism to make larger the second distance X2 (but smaller than the first distance X1) between the support member 112 and the pressing pedestal 141 at the pressing position than that when the weight of the sheet S acquired by the sheet weight recognizing means is equal to or larger than a predetermined value to reduce the pressing force applied to the fold between the additional folding rollers 114 and the pressing pedestal 141. When the sheet section is interposed between the additional folding rollers 114 and the fold as in the case of the second fold 133 to be subjected to the additional folding processing in step S28, a step is formed below the sheet section due to the presence of the fold. Thus, when the weight of the sheet S is small, a step mark is more apt to remain in the sheet section due to the pressing by the additional folding rollers 114. As described above, by reducing the pressing force in step S28 when the weight of the sheet S is smaller than a predetermined value, it is possible to prevent deterioration in the quality of the sheet S after the additional folding processing due to the step mark being left in the sheet section when the sheet section is interposed between the additional folding rollers 114 and the fold. The acquisition method of the information concerning the weight of the sheet S is not particularly limited, and the sheet weight recognizing means may be a screen for an operator to select the sheet type or a sheet weight detection sensor provided in the conveying path 101 of the folding device B.

Figure 16F:
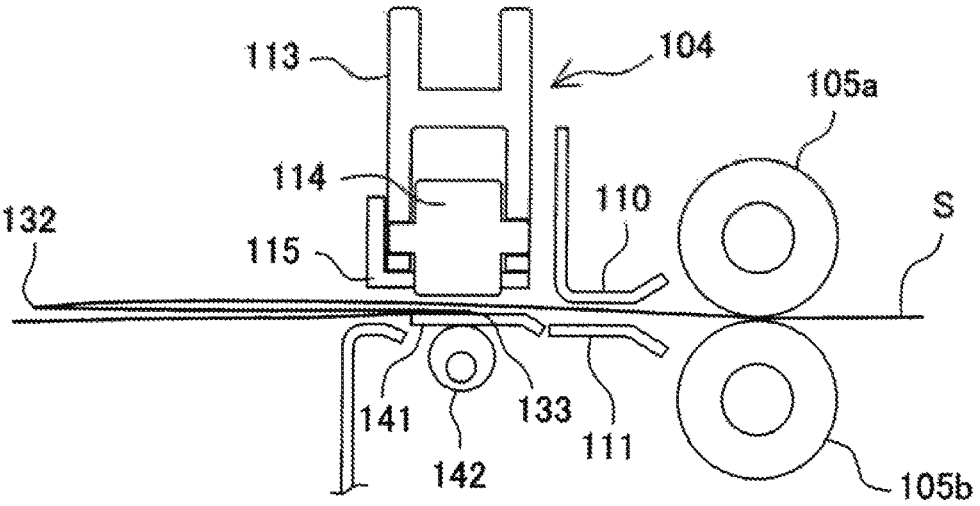

As illustrated in FIG. 16F, as in the additional folding processing for the first fold 132, after completion of the additional folding processing for the second fold 133, the control part 140 controls the first moving mechanism 116 to move upward the additional folding rollers 114 supported by the support member 112 by a predetermined distance toward the retreat position in a direction separating from the pressing pedestal 141 and then conveys the sheet S downstream (step S26).

When two or more folds are formed in one sheet like a Z-folded sheet, a three-folded sheet or the like, the operations from step S23 to step S26 are repeated until additional folding processing for the last fold is completed (step S27). That is, every time the fold of the sheet S is located at the additional folding part, the conveyance of the sheet S is stopped, and the additional folding rollers 114 are moved along the fold of the sheet S to perform additional folding processing. After completion of the additional folding processing for all folds, the sheet S that has been subjected to the additional folding processing is conveyed to the post-processing device C.

Figure 17:
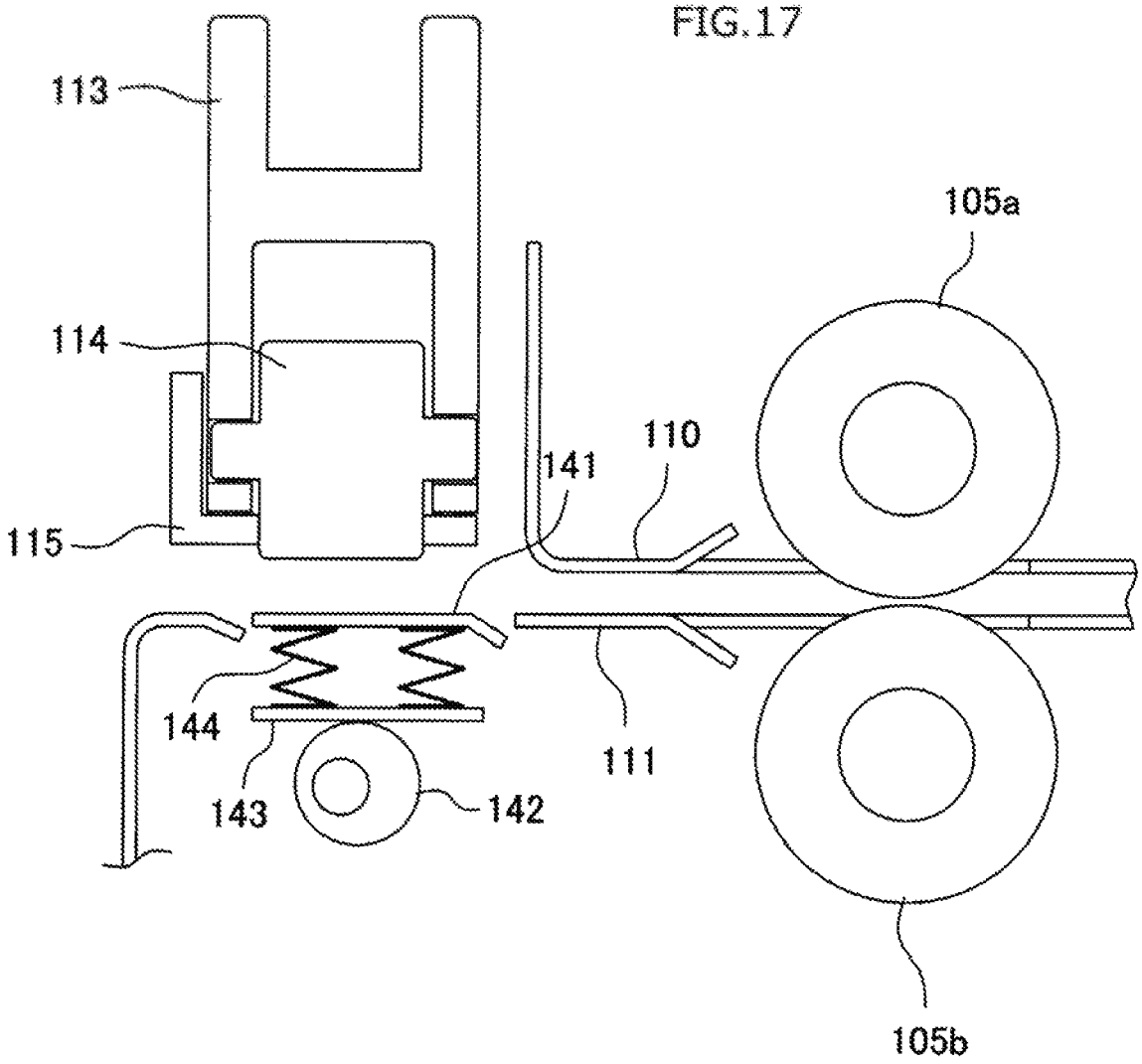
FIG. 17 is a schematic view illustrating a modification of a distance adjusting mechanism illustrated in FIG. 13.

While the sheet pressing device and the image forming system having the same have been described with reference to the illustrated embodiments, the present invention is not limited to the illustrated embodiments. For example, in the illustrated embodiments, the spring 121 is provided between the auxiliary member 113 to which each of the additional folding rollers 114 is rotatably attached and the support member 112 movably supporting the auxiliary member 113 and biases the additional folding roller 114 toward the pressing pedestal 141; however, as illustrated in FIG. 17, in place of, or in addition to the spring 121, a spring 144 may be provided between a base 143 configured to be vertically movable while contacting the pressure adjusting cam 142 and the pressing pedestal 141 so as to bias the pressing pedestal 141 toward the additional folding rollers 114.

Figure 18:
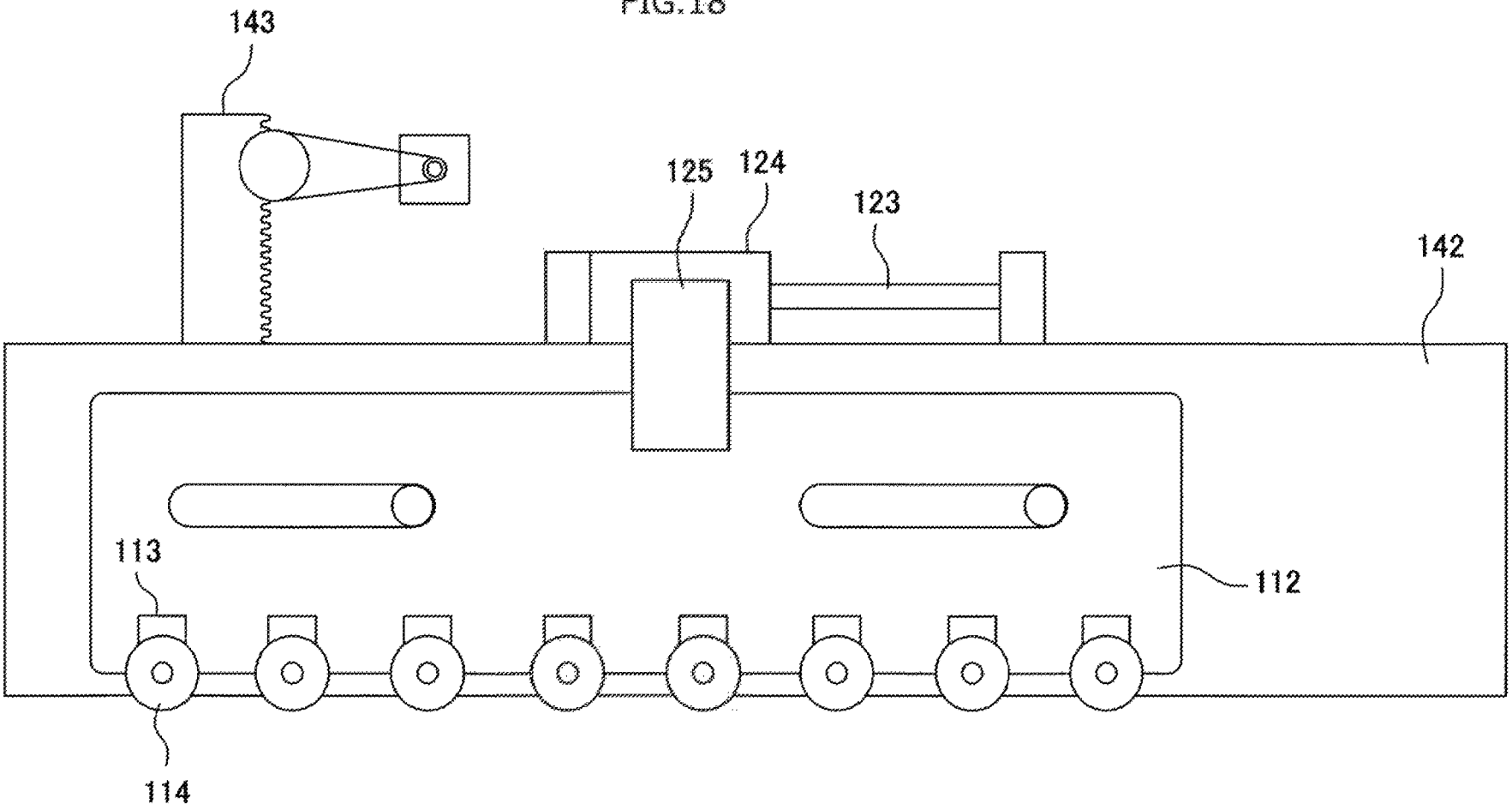
FIG. 18 is a schematic view illustrating a modification of the additional folding unit illustrated in FIG. 3.

While the sheet pressing device and the image forming system having the same have been described with reference to the illustrated embodiments, the present invention is not limited to the illustrated embodiments. In the illustrated embodiments, the first moving mechanism 116 is constituted by the guide rail 123, slider 124, bracket 125, pulley 126, rack 127, additional folding drive motor 128, belt 129, contact piece 130 and the first and second slope parts of the cam groove 131, and the second moving mechanism 117 is constituted by the guide rail 123, slider 124, bracket 125, pulley 126, rack 127, additional folding drive motor 128, belt 129, contact piece 130 and the top horizontal part of the cam groove 131; however, the configurations of the first and second moving mechanisms 116 and 117 are not limited as long as they can make the support member 112 approach/separate from the pedestal part of the lower folding guide 111 and can move the support member 112 along the fold of the sheet S. For example, the configuration illustrated in FIG. 18 may be adopted. That is, the guide rail 123 and the slider 124 are provided on a base member 142, the slider 124 and the support member 112 are connected to each other by the bracket 125, and the slider 124 is driven by a not-shown linear motion mechanism to thereby achieve the horizontal movement of the support member 112 relative to the base member 142. Further, the base member 142 is configured to be vertically movable by the lifting mechanism 143 to thereby achieve the vertical movement of the support member 112. In this case, the guide rail 123, slider 124, bracket 125, and linear motion mechanism function as the second moving mechanism, and the lifting mechanism 146 functions as the first moving mechanism. Further, in this case, it is possible to change the distance between the support member 112 and the pedestal part of the lower folding guide 111 at the pressing position to thereby change the compression amount of the spring 121 at the pressing position, thereby allowing the adjustment of the pressing force applied to the sheet S between the additional folding rollers 114 and pedestal part of the lower folding guide 111. Thus, as described above, when the sheet section is interposed between the additional folding rollers 114 and the fold as in the case of the second fold 133, the control part 140 can control the first moving mechanism 116 so as to increase the pressing force applied to the sheet section and the fold between the additional folding rollers 114 and the pedestal of the lower folding guide 111 as compared to when the additional folding rollers 114 directly face and contact the fold.

Further, in the illustrated embodiments, the additional folding rollers 114 are moved relative to the pedestal part of the lower folding guide 111 by moving the additional folding rollers 114 side (i.e., support member 112); however, the additional folding rollers 114 may be moved relative to the pedestal part of the lower folding guide 111 by moving the pedestal part of the lower folding guide 111. As a matter of course, both the additional folding rollers 114 side and pedestal part of the lower folding guide 111 may be moved. Further, not the additional folding rollers 114, but the pedestal part of the lower folding guide 111 may be biased toward the additional folding rollers 114 by a spring as an elastic member.

What is claimed is:

1. A sheet pressing device that applies additional folding processing to a sheet having three sheet sections partitioned by two folds formed by folding processing and folded in a Z-shape, the device comprising:

a carry-in port that receives a sheet having two folds that have been formed in advance by folding processing and carried in a predetermined carry-in direction;

an additional folding roller disposed downstream of the carry-in port in the carry-in direction and rotated about its rotation axis extending in the carry-in direction to press the two folds;

a pedestal disposed opposite to the additional folding roller to press the two folds in cooperation with the additional folding roller;

a first moving mechanism that moves the additional folding roller between a pressing position at which the additional folding roller is made to approach the pedestal to press the two folds located between the additional folding roller and the pedestal and a retreat position at which the additional folding roller is moved relative to the pedestal from the pressing position in a direction separating from the sheet;

a second moving mechanism that moves the additional folding roller along the two folds in a state where the additional folding roller is moved relative to the pedestal to the pressing position by the first moving mechanism; and a control part that controls operations of the first and second moving mechanisms, wherein the control part controls the second moving mechanism so as to make larger a number of times the additional folding roller is moved along the two folds at the pressing position when one of the three sheet sections is positioned between the additional folding roller and the two folds than when the additional folding roller and the fold are directly opposed to each other.

2. The sheet pressing device according to claim 1, further comprising a sheet weight recognizing unit that acquires weight information of the sheet, wherein the control part controls the second moving mechanism so as to make larger the number of times the additional folding roller is moved along the two folds at the pressing position when the weight of the sheet acquired by the sheet weight recognizing unit is equal to or larger than a predetermined value than when the weight of the sheet is smaller than the predetermined value.

3. The sheet pressing device according to claim 1, further comprising a support member and an elastic member, wherein the additional folding roller is supported by the support member through the elastic member and biased toward the pedestal by the biasing member.

4. The sheet pressing device according to claim 1, wherein the control part controls the second moving mechanism so as to make lower a speed at which the additional folding roller is moved along the two folds at the pressing position when the sheet section is positioned between the additional folding roller and the two folds than when the additional folding roller and the two folds are directly opposed to each other.

5. The sheet pressing device according to claim 1, wherein the control part controls the first moving mechanism so as to make larger pressing force applied to the two folds between the additional folding roller and the pedestal when one the three sheet sections is positioned between the additional folding roller and the two folds than when the additional folding roller and the two folds are directly opposed to each other.

6. An image forming system comprising:

an image forming device that forms an image on a sheet and carries out the image-formed sheet;

a sheet processing device that applies folding processing to the sheet carried out from the image forming device; and the sheet pressing device as claimed in claim 1.

* * * * *